US012584403B2

(12) United States Patent
Ba et al.

(10) Patent No.: US 12,584,403 B2
(45) Date of Patent: Mar. 24, 2026

(54) SYSTEMS AND METHODS FOR DETERMINING DOWNLINKS FOR TRANSMITTING TO A DOWNHOLE TOOL

(71) Applicant: Schlumberger Technology Corporation, Sugar Land, TX (US)

(72) Inventors: Samba Ba, Houston, TX (US); Qiuhua Liu, Houston, TX (US); Prateek Goel, Houston, TX (US); Jan Dolejsi, Crawley (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/588,339

(22) Filed: Feb. 27, 2024

(65) Prior Publication Data

US 2025/0270924 A1 Aug. 28, 2025

(51) Int. Cl.

| | |
|---|---|
| ***E21B 47/12*** | (2012.01) |
| ***E21B 7/04*** | (2006.01) |
| ***E21B 44/00*** | (2006.01) |

(52) U.S. Cl.

CPC ..... *E21B 47/12* (2013.01); *E21B 7/04* (2013.01); *E21B 44/00* (2013.01)

(58) Field of Classification Search

CPC ..... E21B 47/12; E21B 47/125; E21B 47/13; E21B 47/135; E21B 47/138; E21B 47/14; E21B 47/16; E21B 47/18; E21B 47/20; E21B 47/22; E21B 47/24; E21B 7/04; E21B 44/00

See application file for complete search history.

(56) References Cited

U.S. PATENT DOCUMENTS

| | | | | |
|---|---|---|---|---|
| 9,970,284 | B2 | 5/2018 | Tang | |
| 10,844,703 | B2 * | 11/2020 | Jones | E21B 44/005 |
| 12,116,887 | B2 * | 10/2024 | Hamzah | E21B 47/12 |
| 12,281,562 | B2 * | 4/2025 | Wu | E21B 7/04 |
| 2022/0284172 | A1 * | 9/2022 | Rebo | G06N 3/0455 |
| 2022/0349260 | A1 | 11/2022 | Hamzah | |
| 2023/0046043 | A1 | 2/2023 | Hansen | |
| 2023/0392447 | A1 | 12/2023 | Ignova | |

(Continued)

OTHER PUBLICATIONS

Ba, S. et al. "Expanding Downlink Capabilities Using Autonomous Directional Drilling with Rotary Steerable Systems" SPE-211067-MS, presented at the ADIPEC, Abu Dhabi, 2022, 10 Pages.

(Continued)

*Primary Examiner* — Franklin D Balseca
(74) *Attorney, Agent, or Firm* — Jeffrey D. Frantz

(57) ABSTRACT

In some embodiments, a method of implementing an operation of a downhole tool within a wellbore includes identifying a tool command for a downhole tool to change a current state of the downhole tool to a target state. The method further includes determining, from a set of candidate downlink commands, a set of one or more downlink commands associated with executing the tool command. The method further includes generating a downlink sequence of one or more downlinks for communicating the set of one or more downlink commands to the downhole tool. The method further includes providing the downlink sequence for transmitting to the downhole tool.

20 Claims, 12 Drawing Sheets

(56) References Cited

U.S. PATENT DOCUMENTS

| | | | |
|---|---|---|---|
| 2025/0129702 | A1 | 4/2025 | Ba |
| 2025/0270925 | A1 | 8/2025 | Ba |

OTHER PUBLICATIONS

Fox, M. et al. "PDDL 2.1: An Extenstion to PDDL for Expressing Temporal Planning Domains" Journal of Artificial Intelligence Research, 2003, 20, 2003, pp. 61-124.

Liu, Q. et al. "Continuous Feedback Loop Between Surface and Downhole for Autonomously Drilling a Section" SPE-218117-MS, presented at the SPE Canadian Energy Technology Conference and Exhbition, Calgary, Alberta, Canada, 2024, 12 pages.

* cited by examiner 340-1

150

142

OPERATION MODE: BUILD AND TURN

| Downlink ID *144* | Downlink Command *146* | Bit Pattern *148* |
|---|---|---|
| 1-0 | TF = 0°, SR=25% | 10110010 |
| 1-1 | TF = 0°, SR=50% | 10010011 |
| 1-2 | TF = 0°, SR=75% | 10101100 |
| 1-3 | TF = 0°, SR=100% | 01010010 |
| 1-4 | TF = 18°, SR=75% | 10100101 |
| 2-1 | TF = 18°, SR=100% | 11100100 |
| 2-2 | TF = 36°, SR=50% | 00101101 |
| 2-3 | TF = +6° | 10110101 |
| 2-4 | TF = -6° | 01101010 |
| . | . | . |
| . | . | . |
| . | . | . |
| 2-20 | Set Build and Turn Mode | 11010110 |
| . | . | . |
| . | . | . |
| . | . | . |

FIG. 3-2

340-2

150

142

OPERATION MODE: HIA

| Downlink ID *144* | Downlink Command *146* | Bit Pattern *148* |
|---|---|---|
| 1-0 | Target Inc. = +0.1° | 10110010 |
| 1-1 | Target Inc. = +0.2° | 10010011 |
| 1-2 | Target Inc. = +0.5° | 10101100 |
| 1-3 | Target Inc. = -0.1° | 01010010 |
| 1-4 | Target Inc. = -0.2° | 10100101 |
| 2-1 | Target Inc. = -0.5° | 11100100 |
| 2-2 | Target Azi. = +0.1° | 00101101 |
| 2-3 | Target Azi. = +0.2° | 10110101 |
| 2-4 | Target Azi. = +0.5° | 01101010 |
| . | . | . |
| . | . | . |
| . | . | . |
| 2-21 | Set HIA Mode | 11010110 |
| . | . | . |
| . | . | . |
| . | . | . |

FIG. 3-3

SYSTEMS AND METHODS FOR DETERMINING DOWNLINKS FOR TRANSMITTING TO A DOWNHOLE TOOL

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores.

Downhole tools implemented within wellbores may be controlled based on downlink commands communicated to the downhole tool through downlink signals from the surface of the wellbore. Due to the large depths at which downhole tools often operate, communication between the downhole tool and surface equipment may be limited, slow, and rudimentary. Accordingly, the number of downlink commands that are available for communication to the downhole tool may be limited. A trajectory of the wellbore may be achieved based on implementing a series of tool command indicated in a drill plan. In many cases, however, it may not be possible to communicate the exact parameters of the tool commands due to the limited number of downlinks and associated downlink commands available for transmission. Thus, improved techniques for determining and implementing downlinks that sufficiently approximate the tool commands may be advantageous.

SUMMARY

In some embodiments, a method of implementing an operation of a downhole tool within a wellbore includes identifying a tool command for a downhole tool to change a current state of the downhole tool to a target state. The method further includes determining, from a set of candidate downlink commands, a set of one or more downlink commands associated with executing the tool command. The method further includes generating a downlink sequence of one or more downlinks for communicating the set of one or more downlink commands to the downhole tool. The method further includes. providing the downlink sequence for transmitting to the downhole tool. In some embodiments, the method is performed by a system. in some embodiments, the method is performed as instructions included on a computer-readable storage medium.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 illustrates an example environment in which a downlink generation system is implemented, according to at least one embodiment of the present disclosure;

FIG. 2-2 illustrates an example implementation of a downlink generation system as described herein, according to at least one embodiment of the present disclosure;

FIG. 3-1 illustrates an example drill plan, according to at least one embodiment of the present disclosure;

FIG. 3-2 illustrates an example set of downlink definitions associated with a downhole tool, according to at least one embodiment of the present disclosure;

FIG. 3-3 illustrates an example set of downlink definitions associated with a downhole tool, according to at least one embodiment of the present disclosure;

DETAILED DESCRIPTION

Figure 1:
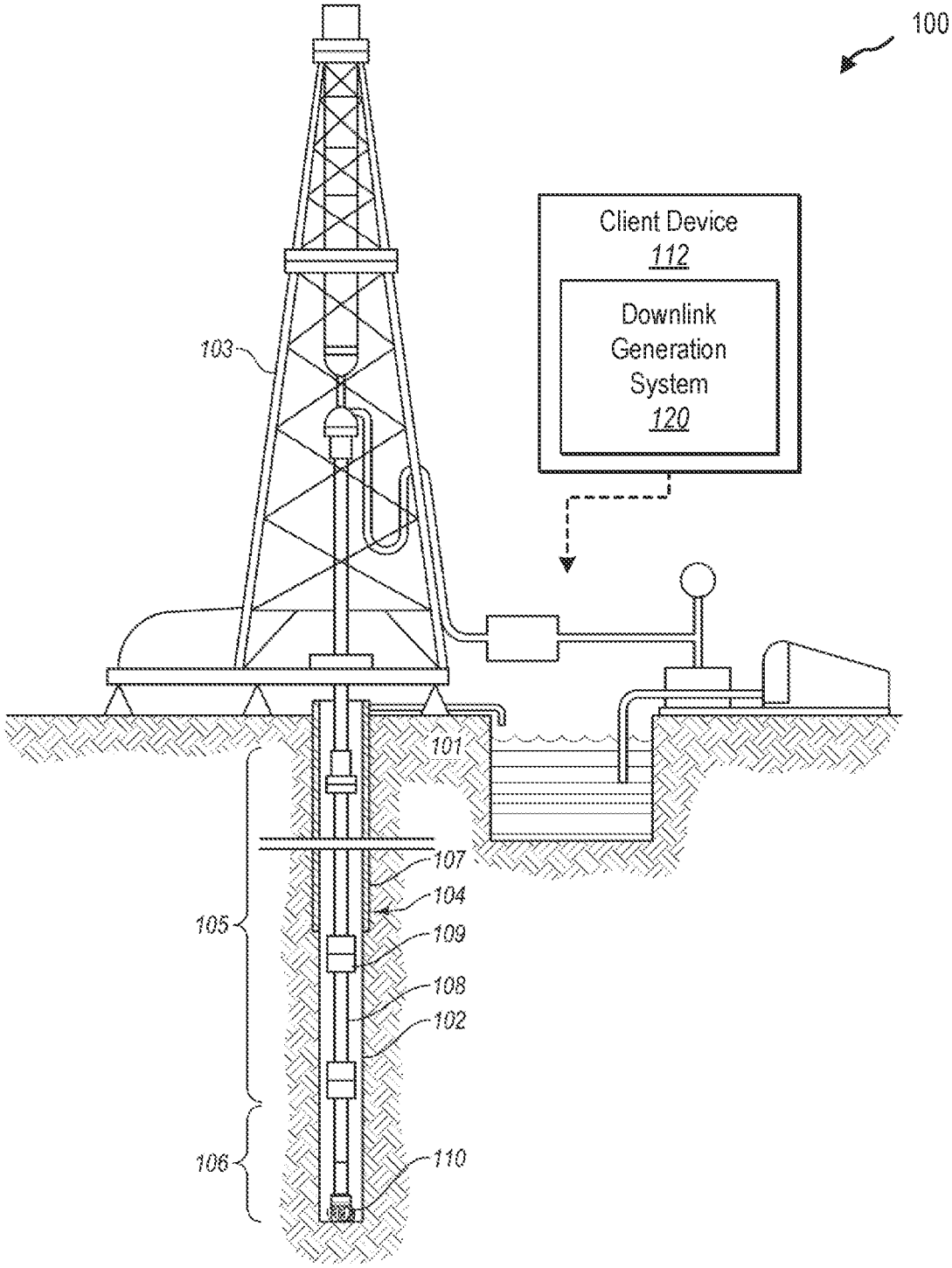
FIG. 1 is an example of a downhole system, according to at least one embodiment of the present disclosure.

This disclosure generally relates to systems and methods for generating downlinks for transmitting commands to a downhole tool. A downhole tool may be implemented in a wellbore, and communication with the downhole tool may be accomplished by sending signals through surface parameters provided to the downhole tool from equipment at the surface of the wellbore. For example, bit patterns may be encoded into surface parameters such as flow rates, pressures, and/or rotational speed (RPM) by modulating these parameters. The downhole tool may detect the modulations and, in this way, receive information from the surface.

In some cases, downlinks may be sent to downhole tools in this manner to instruct the downhole tool how to operate. For example, downlinks may be used to communicate downlink commands to the downhole tool instructing the downhole tool to implement a specific operation mode and/or specific operation parameters in accordance with a planned operation of the downhole tool.

A downlink generation system may identify, from a drill plan, a trajectory with associated tool commands for executing the trajectory. For example, the trajectory may be segmented into various sections and tool commands may indicate an operation mode and operation parameters for the downhole tool to achieve each section of the trajectory. In order to communicate the tool commands to the downhole tool, the downlink generation system may determine a sequence of one or more downlinks for transmitting instructions for the downhole tool to implement in order to execute the tool commands. For example, the downhole tool may be configured to operate based on a finite, limited number of downlink commands communicate through a finite, limited number of downlinks. The downlink generation system may identify a sequence of one or more downlink commands for communicating to the downhole tool in order to execute the tool command as closely as possible.

As will be discussed in further detail below, the present disclosure includes a number of practical applications having features described herein that provide benefits and/or solve problems associated with determining downlinks for transmitting to downhole tools. Some example benefits are discussed herein in connection with various features and functionalities provided by a downlink generation system implemented on one or more computing devices. It will be appreciated that benefits explicitly discussed in connection with one or more embodiments described herein are provided by way of example and are not intended to be an exhaustive list of all possible benefits of the downlink generation system.

For example, determining which downlinks to transmit to a downhole tool in order to control the downhole tool may typically be determined at the expense of significant time and resources, such as through manual efforts. Thus, changes to this phase of creating a drill plan may be costly and slow, and may lead to bottlenecking and other issues. These limitations are worsened by the fact that drill plans and trajectories may be frequently updated requiring new sets and sequences of downlinks to be determined in order to implement the updates. The downlink generation system described herein may determine downlink sequences for controlling the downhole tool automatically, quickly, and in real time which may streamline the process and provide significant cost, time, and convenience savings. This provides the added benefit of being able to adapt quickly and seamlessly to updates or changes to the wellbore trajectory.

Further, in many cases, downhole tools are typically only configured to communicate through a limited number of downlinks. Thus, the downlink commands available for instructing the downhole tool how to operate may, in many cases, not be sufficient for implementing the exact parameters of a tool command outlined in a drill plan. Typically, downlinks are selected manually by drilling personnel through experience, insight, and intuition, which can lead to communicating downlink commands to the downhole tool that are incorrect, incomplete, or otherwise not optimal. The downlink generation system may determine which downlink, or series of downlinks, can be implemented by the downhole tool in order to arrive at a closest approximation of the tool command. Additionally, in many cases a tool command may be associated with implementing several operation parameters at a time, any (or all) of which may not be entirely achievable with the downlinks available for transmission. The downlink generation system may determine which downlinks (or sequences of downlinks) may be implemented for achieving an approximation that best represents all of the associated operation parameters. Further, the downlink generation system may incorporate factors such as the interplay between operation parameters to characterize how one operation parameter effects the behavior of another, in order to select the optimal downlinks for communication to the downhole tool. In this way, the downlink generation system may determine with an increased accuracy the downlinks for instructing the operation of the downhole tool.

Additional details will now be provided regarding systems described herein in relation to illustrative figures portraying example implementations. For example, FIG. 1 shows one example of a downhole system 100 for drilling an earth formation 101 to form a wellbore 102. The downhole system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of the drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 further includes additional downhole drilling tools and/or components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110, other downhole drilling tools, or other components. Examples of additional downhole tools include collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as one or more of gravity, magnetic north, or true north. Using measurements obtained with the geostationary position, the RSS may locate the bit 110, change the course of the bit 110, and direct the directional drilling tools on a projected trajectory. The RSS may be implemented to direct the bit 110 in accordance with or based on a trajectory for the bit 110. For example, a trajectory may be determined for directing the bit 110 toward one or more subterranean targets such as an oil or gas reservoir. The RSS may be controlled in accordance with commands or instructions, for example, transmitted to the RSS via downlinks from the surface of the wellbore. Through downhole telemetry techniques, the RSS may communicate various information back to the surface.

The downhole system 100 may include or may be associated with a client device 112 with a downlink generation system 120 implemented thereon (e.g., implemented on one, several, or across multiple client devices 112). The downlink generation system 120 may facilitate determining, generating, and/or transmitting downlinks to the RSS (or other downhole tools) to control the RSS.

Figures 1, 2:
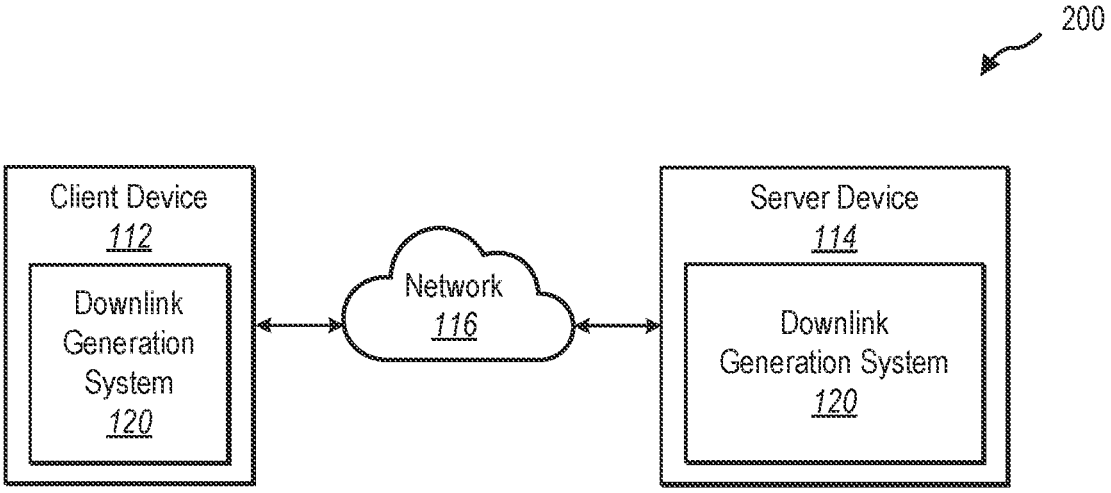
Figure 2:
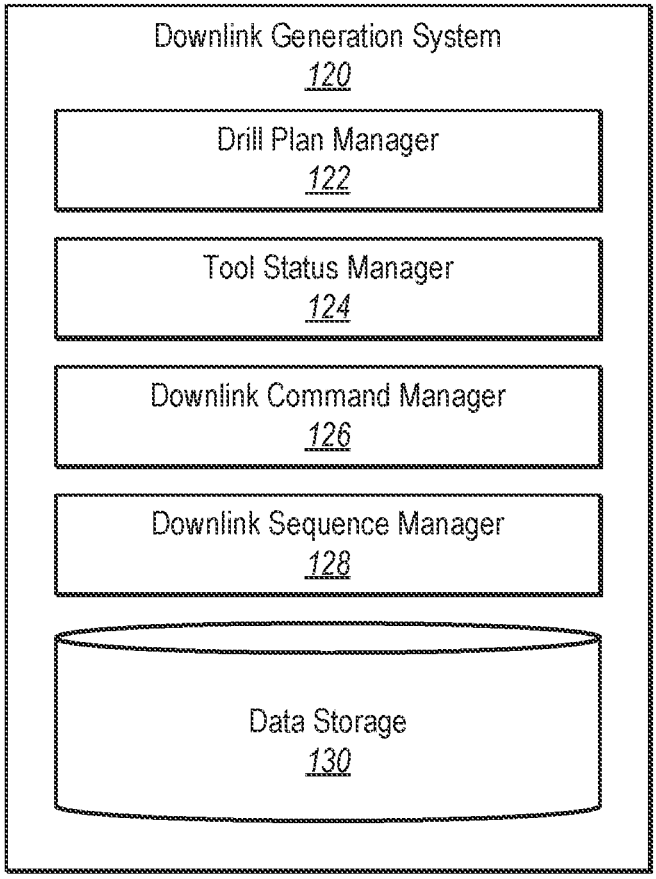

FIG. 2-1 illustrates an example environment 200 in which a downlink generation system 120 is implemented in accordance with one or more embodiments describe herein. As shown in FIG. 2-1, the environment 200 includes a server device 114. The server device 114 may include one or more computing devices (e.g., including processing units, data storage, etc.) organized in an architecture with various network interfaces for connecting to and providing data management and distribution across one or more client systems. As shown in FIG. 2-1, the server device 114 may be connected to and may communicate with (either directly or indirectly) a client device 112 through a network 116. The network 116 may include one or multiple networks and may use one or more communication platforms and/or technologies suitable for transmitting data. The network 116 may refer to any data link that enables transport of electronic data between devices of the environment 200. The network 116 may refer to a hardwired network, a wireless network, or a combination of a hardwired network and a wireless network. In one or more embodiments, the network 116 includes the internet. The network 116 may be configured to facilitate communication between the various computing devices via well-site information transfer standard markup language (WITSML) or similar protocol, or any other protocol or form of communication.

The client device 112 may be representative of one or multiple client devices, and may refer to various types of computing devices. For example, the client device 112 may include a mobile device such as a mobile telephone, a smartphone, a personal digital assistant (PDA), a tablet, a laptop, or any other portable device. Additionally, or alternatively, the client device 112 may include one or more non-mobile devices such as a desktop computer, server device, surface or downhole processor or computer (e.g., associated with a sensor, system, or function of the downhole system), or other non-portable device. In one or more implementations, the client device 112 includes graphical user interfaces (GUI) thereon (e.g., a screen of a mobile device). In addition, or as an alternative, one or more of the client device 112 may be communicatively coupled (e.g., wired or wirelessly) to a display device having a graphical user interface thereon for providing a display of system content. The server device 114 may similarly refer to various types of computing devices. Each of the devices of the environment 200 may include features and/or functionalities described below in connection with FIG. 9.

As shown in FIG. 2-1, the environment 200 may include a downlink generation system 120 implemented on one or more computing devices. The downlink generation system 120 may be implemented on one or more of the client device 112, the server device 114, and combinations thereof. Additionally, or alternatively, the downlink generation system 120 may be implemented across the client devices 112 and/or the server devices 114 such that different portions or components of the downlink generation system 120 are implemented on different computing devices in the environment 200. In this way, the environment 200 may be a cloud computing environment, and the downlink generation system 120 may be implemented across one or more devices of the cloud computing environment in order to leverage the processing capabilities, memory capabilities, connectivity, speed, etc., that such cloud computing environments offer in order to facilitate the features and functionalities described herein.

FIG. 2-2 illustrates an example implementation of the downlink generation system 120 as described herein, according to at least one embodiment of the present disclosure. The downlink generation system 120 may include a drill plan manager 122, a tool status manager 124, a downlink command manager 126, and a downlink sequence manager 128. The downlink generation system 120 may also include a data storage 130 having various types of data. While one or more embodiments described herein describe features and functionalities performed by specific components 122-128 of the downlink generation system 120, it will be appreciated that specific features described in connection with one component of the downlink generation system 120 may, in some examples, be performed by one or more of the other components of the downlink generation system 120.

By way of example, one or more of the data receiving, gathering, or storing features of the drill plan manager 122 may be delegated to other components of the downlink generation system 120. As another example, while sequences of downlinks may be generated by the downlink sequence manager 128, in some instances, some or all of these features may be performed by the downlink command manager 126 (or other component of the downlink generation system 120). Indeed, it will be appreciated that some or all of the specific components may be combined into other components and specific functions may be performed by one or across multiple components 122-128 of the downlink generation system 120.

Additionally, while FIG. 1, for example, depicts the downlink generation system 120 implemented on a client device 112 of the downhole system, it should be understood that some or all of the features and functionalities of the downlink generation system 120 may be implemented on or across multiple client devices 112 and/or server devices 114. For example, data may be input and/or received by the drill plan manager 122 on a (e.g., local) client device, and the sequences of downlink commands and/or downlinks may be determined on one or more of a remote, server, or cloud device. Indeed, it will be appreciated that some or all of the specific components 122-128 may be implemented on or across multiple client devices 112 and/or server devices 114, including individual functions of a specific component being performed across multiple devices.

The downlink generation system 120 may facilitate communicating commands to a downhole tool via downlinks sent from the surface. For example, the downhole tool may be a steering tool and the downlink generation system 120 may facilitate communicating steering commands to the steering tool in order that the steering tool may direct the drill string toward, around, or to one or more underground features. It should be understood, however, the downlink generation system 120 and the techniques described herein may be applicable to any tool implemented downhole such as, for example, measurement (MWD) tools, logging (LWD) tools, drilling tools, or any other downhole tool.

As mentioned above, the downlink generation system 120 includes a drill plan manager 122. The drill plan manager 122 may receive a variety of types of data associated with the downhole system and may store the data to the data storage 130. The drill plan manager 122 may receive the data from a variety of sources, such as from sensors, surveying tools, downhole tools, other (e.g., client) devices, libraries, databases, user input, etc.

Figures 1, 3:
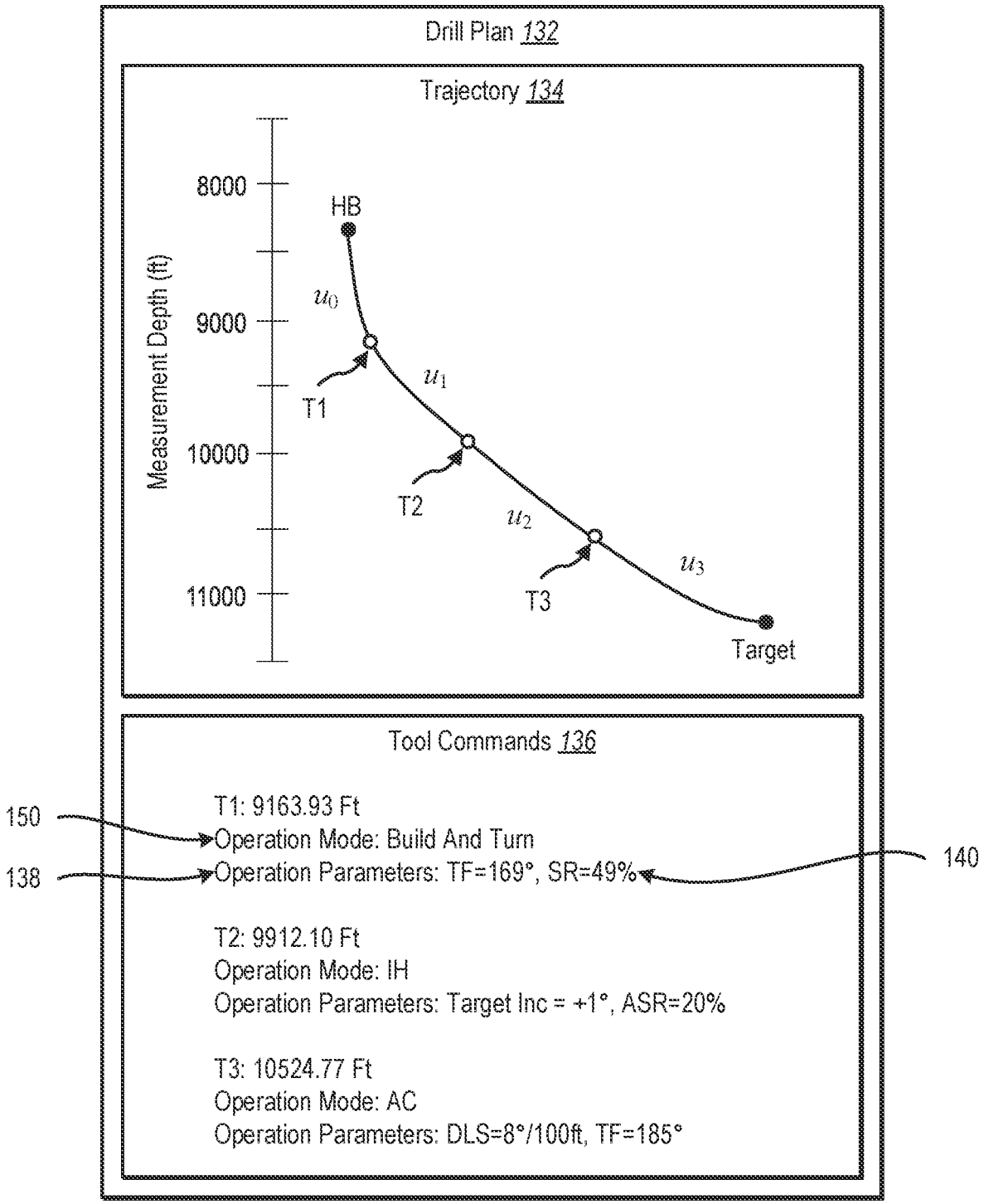

In some embodiments, the drill plan manager 122 receives a drill plan. FIG. 3-1 illustrates an example drill plan 132, according to at least one embodiment of the present disclosure. The drill plan 132 may indicate or outline a plan for various aspects of the wellbore. The drill plan 132 may be generated as part of a planning phase of the wellbore, and may be updated one or more times throughout the construction, implementation, and operation of the wellbore. The drill plan manager 122 may maintain and update the drill plan 132 as it is planned and/or becomes available. For example, the drill plan manager 122 may receive, in real time, any of the data described herein, including real time updates to the drill plan 132. This may facilitate the downlink generation system 120 performing the downlink determination and generation techniques described herein in real time. For instance, the downlink generation system 120 may determine a sequence of one or more downlinks to transmit to the downhole tool in real time as the wellbore is being drilled and as certain tool commands are indicated in the drill plan 132 to be applied. In another example, the downlink generation system 120 may determine some or all of the downlink sequences ahead of time (e.g., for the whole trajectory) as the drill plan 132 is updated.

In some embodiments, the drill plan 132 includes information related to a trajectory 134, or a path for the downhole tool to follow from a hole bottom (HB) to reach a target, such as an underground reservoir. The trajectory may exhibit a 2- or 3-dimensional geometry for the downhole tool to traverse. The drill plan 132 may indicate one or more tool commands 136 for the downhole tool to implement in order to achieve the trajectory 134. For example, in order to achieve the (e.g., complex geometry of) trajectory 134, the trajectory 134 may be segmented into various sections. The trajectory 134 may have example sections $u_0$-$u_3$ with transitions T1-T3 therebetween. The trajectory 134 may be divided into the sections based on a specific operation mode and/or operation parameters for the downhole tool to implement at associated measurement depths in order to achieve the desired geometry for each section of the trajectory 134. For example, the drill plan 132 may indicate the tool commands 136 corresponding to the sections $u_0$-$u_3$ and/or transitions T1-T3. In some embodiments, the tool commands 136 indicate a specific operation mode 150 for the downhole tool to implement for a corresponding section (e.g., beginning at the associated transition). In some embodiments, the tool commands 136 indicate specific operation parameters 138 for the operation mode 150 for the downhole tool to implement at associated operation parameters values 140.

As an illustrative example, the drill plan 132 may indicate that a first transition Tl between an initial or active section u0 and a first section u1 occurs as a measurement depth of around 9,100 ft. The tool commands 136 may indicate for the downhole tool to achieve the first section u1 of the trajectory 134 by implementing an operation mode 150 of "Build and Turn" with operation parameters 138 of a tool face angle of 169° and a steering ratio of 49% beginning at the first transition T1. The drill plan 132 may indicate that a second transition T2 between the first section u1 and a second section u2 occurs at a measurement depth of around 9,900 ft. The tool commands 136 may indicate for the downhole tool to achieve the second section u2 of the trajectory 134 by implementing an operation mode 150 "IH" (inclination hold as described herein) with operation parameters 138 of increasing the target inclination by 1° and implementing an azimuthal steering ration ratio of 20% beginning at the second transition T2. Further, the drill plan 132 may indicate that a third transition T3 between the second section u2 and a third section u3 occurs at a measurement depth of around 10,500 ft. The tool commands 136 may indicate for the downhole tool to achieve the third section u3 by implementing an operation mode 150 of "AC" (auto curve a described herein) with operation parameters 138 of a dog leg severity of 8° per 100 ft and a toolface angle of 185° beginning at the third transition T3. In this way, the drill plan 132 may indicate how the trajectory 134 is to be achieved through the tool commands 136. The drill plan manager 122 may receive and/or update the drill plan 132 by accessing a database or other computing system, or through user input.

In some embodiments, the drill plan manager 122 receives information related to the capabilities of the downhole tool. For example, the drill plan manager 122 may receive or access a configuration or specification of the downhole tool. The configuration may be associated with a specific type, model, manufacturer, and/or firmware of the downhole tool. The configuration may indicate the various operation modes 150 that the downhole tool is configured to implement, including the various operation parameters 138 associated with a given operation mode 150. Additionally, the configuration may additionally indicate the specific operation parameter values 140 that the downhole tool may apply in order to implement each operation parameters 138. As described herein, the downhole tool may be configured to implement a finite, discrete, and/or limited number of operation parameters values 140 for each operation parameters 138, and in some cases, a given operation parameter value 140 indicated in the tool commands 136 may not be achievable based on the (e.g., limited) configuration of the downhole tool.

As just mentioned, the configuration may indicate the operation modes 150 for the downhole tool. In one example, the downhole tool may be configured for a manual or "Build and Turn" mode (e.g., manual steering mode). The "Build and Turn" mode may operate based on operation parameters such as one or more of: a toolface mode (e.g., gravity toolface mode, magnetic toolface mode, etc.), a toolface angle (with respect to a coordinate system defined by the toolface mode), or a steering ratio. The "Build and Turn" mode may be a manual or open loop mode in that the downhole tool may not make automatic adjustments or changes, but rather may operate, for example, in accordance with the specific toolface angle, toolface mode, and steering ratio indicated by the associated operation parameters.

In various examples, the downhole tool may operate in one or more automatic, or closed-loop modes in which the downhole tool may automatically implement changes or adjustments in accordance with the mode and in accordance with associated operation parameters. In one example, the downhole tool may be configured for an automatic vertical mode in which the downhole tool will automatically maintain a vertical or downward orientation. In another example, the downhole tool may be configured for an automatic "inclination hold" (IH) mode in which the downhole tool may maintain a given inclination. The IH mode may operate based on operation parameters such as one or more of: a target inclination, an inclination nudge size, or an azimuthal steering ratio. In another example, the downhole tool may be configured for an automatic "inclination and azimuth hold" (HIA) mode in which the downhole tool may maintain a given inclination and a given azimuth for tangents and laterals. The "HIA" mode may operate based on operation parameters such as one or more of: a target inclination, an inclination nudge size, a target azimuth, or an azimuth nudge size. In another example, the downhole tool may be configured for an automatic "auto curve" (AC) mode in which the downhole tool may automatically execute a curve of a given size and orientation. The "AC" mode may operate based on operation parameters such as one or more of: a dog leg severity or a toolface mode. In this way, the downhole tool configuration may indicate various operations that the downhole tool can perform based on the various modes in which it can operate. The downhole tool may be configured to implement any other operation mode and may be configured to change between different operation modes.

In some embodiments, the configuration may include instructions for communicating with the downhole tool. For example, the downhole tool may be configured to implement the operation modes 150 and associated operation parameters 138 based on signals or downlinks received by the downhole tool from the surface. The configuration may include a set of downlink definitions that define various downlinks (e.g., including downlink IDs, downlink commands, and bit patterns) for transmitting to the downhole tool in order to implement and/or change the operation mode 150 and/or operation parameters 138 (and associated operation parameter values 140) of the downhole tool. The drill plan manager 122 may access the downlink definitions, for example, by receiving and/or loading a file describing the set of available downlinks for the downhole tool. For instance, the file may be a Json or xml file, or any other format for which the downlink definitions can be stored, retrieved, and/or accessed. The drill plan manager 122 may access the downhole definitions, for example, from a cloud server (e.g., via the network 116 and/or server device 114).

FIGS. 3-2 and 3-3 illustrate example sets of downlink definitions 340-1 and 340-2 (respectively) associated with a downhole tool, according to at least one embodiment of the present invention. The downlink definitions 340-1 may be associated with an operation mode 150 of "Build and Turn", and the downlink definitions 340-2 may be associated with an operation mode 150 of "HIA."

In some embodiments, the downhole tool may be configured to communicate via a finite number of discrete, unique downlinks 142, such as 32 discrete downlinks, 64 discrete downlinks, 128 discrete downlinks, or any other discrete number of downlinks. The downlinks 142 may be identifiable by a unique downlink ID 144. The downlink ID 144 may be a code or combination of one or more integer numbers that, when received, can be translated (e.g., based on the downlink definitions) to indicate an associated downlink command 146. The downlink command 146 may be a specific set of instructions for the downhole tool to implement, such as implementing a specific operation mode or operation parameters 138 (with associated operation parameter values 140). A downlink 142 may be communicated to the downhole tool through an associated bit pattern 148.

In some embodiments, the downlink command 146 for a given downlink ID 144 may instruct the downhole tool to implement a specific operation mode 150. For example, as shown in FIG. 3-2, a downlink 142 having a downlink ID 144 of "2-20" may indicate to the downhole tool to implement or change to an operation mode 150 of "Build and Turn". A downlink 142 (and associated downlink command 146) may instruct the downhole tool to implement or change to any operation mode 150 as described herein. For example, a downlink 142 may instruct the downhole tool to change to an operation mode 150 of "IH," "HIA," or "AC," or any other operation mode 150 of the downhole tool. In this way, one or more downlinks may be associated with implementing a specific operation mode.

In some embodiments, the downlink command 146 may instruct the downhole tool with respect to one or more specific operation parameters 138. For example, the downlink command 146 may instruct the downhole tool to implement one or more operation parameters 138 with specific operation parameter values 140. For instance, as shown in FIG. 3-2, a downlink 142 having a downlink ID 144 of "1-1" may indicate to the downhole tool to implement a toolface angle of 0° and a steering ratio of 50%. In another example, the downlink command 146 may instruct the downhole tool to implement a change to one or more operation parameter values 140 of a certain degree or amount. For instance, a downlink 142 having a downlink ID 144 of "2-3" may indicate to the downhole tool to increase the toolface angle by 6°. In this way, the downhole tool may implement operation parameters 138 with specific operation parameters values 140 based on the downlink commands 146 communicated to the downhole tool via downlinks 142.

A downlink 142 (and associated downlink command 146) may instruct the downhole tool with respect to any operation parameter for the downhole tool and for any operation mode of the downhole tool. For example, a downlink 142 may instruct the downhole tool to implement a (or an amount of change to a) specific inclination angle, dogleg severity, rate of penetration (ROP), or any operation parameter value 140 as described herein. Additionally, the downlink command 146 may instruct the downhole tool to implement a (or an amount of change to a) specific operation parameter value for a given amount of time, distance, angle, percent or until a desired quantity or value is otherwise obtained. In this way, the downhole tool may operate based on the downlink commands 146 associated with the downlinks 142.

As mentioned above, the downlinks 142 may be transmitted to the downhole tool based on an associated bit pattern 148. For example, a downlink 142 may be encoded into one or more surface parameters (e.g., flow rate, pressure, rotational speed) supplied at the surface of the wellbore by modulating the surface parameters according to the defined bit pattern 148. The downhole tool may accordingly include sensors and/or componentry for detecting and identifying the bit pattern 148 sent through the modulations of the surface parameters. In some embodiments, the configuration may indicate how to communicate the bit pattern 148 by modulating the surface parameters. For example, bit pattern 148 may be a binary encoding and the configuration may indicate how to modulate the surface parameters in order to encode the bit pattern 148 into the surface parameters. For instance, the configuration may indicate how to implement certain values or changes in values (e.g., psi, RPM, gal/s, etc.) of the surface parameters and for certain time intervals in order to represent the various bits of the bit pattern 148.

In this way, based on a desired operation mode and/or desired operation parameters for the downhole tool to implement, a downlink ID 144 (e.g., or a series or sequence of downlink IDs 144) may be selected, and the downlink ID 144 may be communicated to the downhole tool by transmitting a downlink 142 to the downhole tool as a bit pattern 148 encoded into one or more surface parameters. The downhole tool may accordingly detect and interpret the bit pattern 148 into the associated downlink ID 144 in order to implement the associated downlink command 146 for achieving the desired operation mode 150 and/or desired operation parameter values 140.

A mentioned above, the downlink generation system 120 includes a tool status manager 124. The tool status manager 124 may determine and/or update a downhole tool status or a current state of the downhole tool. The state of the downhole tool may indicate the operation mode, operation parameters, and operation parameter values that the downhole tool is implementing, executing, or otherwise applying. For example, the tool status manager 124 may receive an indication of the state via communications from the downhole tool, such as downhole telemetry communications received at the surface of the wellbore. In another example, the tool status manager 124 may determined the state, for example based on one or more downlinks sent to the downhole tool. To elaborate, when one or more downlinks are sent to the downhole tool that indicate for the downhole tool to implement a specific mode and/or operation parameter values, the tool status manager 124 may accordingly determine (or update) the state in order to reflect the downlink commands sent via the downlinks. In some embodiments, the tool status manager 124 may verify the state based on confirming that the downhole tool received the downlinks that were sent from the surface, such as by comparing the downlink commands of the downlink with one or more downhole parameters that the downhole tool communicates (e.g., via downhole telemetry) to ensure that the downhole tool is implementing the changes in accordance with the downlink commands. In this way the tool status manager 124 may determine a current state of the downhole tool.

The current state of the downhole tool may facilitate determining which downlinks to send to the downhole tool. For example, a tool command of the drill plan may indicate for a certain operation mode to be implemented, and the current status may indicate the current operation mode in order to determine whether a downlink needs to be sent to change the operation mode. As another example, in some embodiments downlink IDs may be dependent on a specific operation mode of the downhole tool. For instance, a downlink ID of "2-5" may signify a first downlink command for a first operation mode, and the same downlink ID of "2-5" may signify a second, different downlink command for a second operation mode. The current status may accordingly inform what downlink command corresponding to a give downlink ID. In another example, as described herein one or more downlink commands may be associated with changing (e.g., increasing or decreasing) an operation parameter value in contrast to, for example, implementing a specific operation parameter value. Accordingly, the current status may inform what downlink commands to implement in order achieve a given operation parameter value.

In some embodiments, the tool status manager 124 may determine a desired, goal, or target state for the downhole tool. For example, based on the drill plan (and one or more depth measurements received from the downhole system) the tool status manager 124 may determine a current location (e.g., depth) for the wellbore and/or downhole tool. For instance, the tool status manager 124 may determine at what measurement depth the hole bottom of the wellbore is currently located. In some embodiments, the tool status manager 124 may determine, based on the drill plan, the section and/or transition (and associated tool commands) of the trajectory that may actively (or next) apply to the current location of the downhole tool and/or of the wellbore hole bottom (e.g., the current state). Accordingly, the tool status manager 124 may determine a next transition and/or next section of the trajectory and may determine the corresponding tool commands to implement for the next trajectory section. In this way, the next tool command may inform the target state that the tool status manager 124 determines. The target state in this way may facilitate identifying a sequence of one or more downlink commands and associated downlinks to send to the downhole tool, as described herein.

Figure 4:
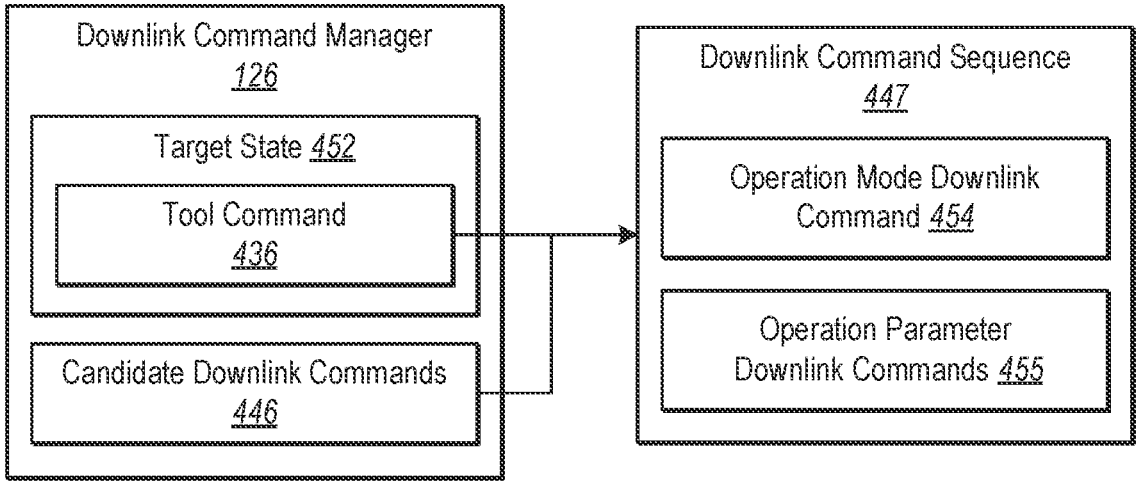
FIG. 4 illustrates example features and functionalities of a downlink command manager, according to at least one embodiment of the present disclosure.

As mentioned above, the downlink generation system 120 includes a downlink command manager 126. The downlink command manager 126 may determine a downlink command, or a sequence of several downlink commands, for the downhole tool to implement. FIG. 4 illustrates example features and functionalities of the downlink command manager 126, according to at least one embodiment of the present disclosure.

In some embodiments, the downlink command manager 126 may access a target state 452 for the downhole tool. As described herein, the target state 452 may indicate, based on a set of tool commands 436, an operation mode for the downhole tool to implement, as well as operation parameters and associate operation parameters values to implement for the operation mode for a given section or transition of the trajectory.

Based on the target state 452, the downlink command manager 126 may select, from a set of candidate downlink commands 446, a downlink command sequence 447 of one or several downlink commands. For example, the candidate downlink commands 446 may include some or all of the downlink commands indicated in the downlink definitions of the downhole tool configuration. The downlink command manager 126 may select the downlink command sequence 447 for the downhole tool to implement in order to execute the tool command 436 and/or achieve the target state 452. For example, the downlink command sequence 447 may be a set of one or more downlink commands that result in (or approximate as described herein) a target operation mode and/or target operation parameters of the target state 452.

In some embodiments, the downlink command sequence 447 may include an operation mode downlink command 454, or a downlink command for instructing the downhole tool to implement a specific operation mode. For example, based on the tool command 436, the downlink command manager 126 may determine a target operation mode for the downhole tool to implement. The downlink command manager 126 may compare the target operation mode to a current operation mode of a current state of the downhole tool and, based on the current operation mode being a different operation mode than the target operation mode, the downlink command manager 126 may determine an operation mode downlink command 454 to include in the downlink command sequence 447 for the downhole tool to implement the target operation mode. As an illustrative example, the downlink command manager 126 may identify that a current operation mode for the current state of the downhole tool is an operation mode of "AC" and may additionally identify that in order to achieve a target state 452 of an upcoming transition of the trajectory, the tool command 436 indicates a target operation mode of "Build and Turn." Accordingly, the downlink command manager 126 may select, from the candidate downlink commands 446, an operation mode downlink command 454 to include in the downlink command sequence 447 for changing the operation mode to "Build and Turn." In some embodiments, the downlink command manager 126 determines that the target operation mode and the current operation mode are the same, and accordingly determines that an operation mode downlink command 454 does not need to be incorporated into the downlink command sequence 447. In this way, the downlink command sequence 447 may facilitate implementing a target operation mode of the target state 452.

In some embodiments, the downlink command sequence 447 includes one, or multiple, operation parameter downlink commands 455. The operation parameters downlink commands 455 may be downlink commands associated with implementing specific operation parameters, at associated operation parameter values, for a given operation mode. For example, based on the tool command 436, the downlink command manager 126 may determine one or more target operation parameter values for target operation parameters for the downhole tool to implement. The downlink command manager 126 may compare the target operation parameter values for the target operation parameters to current operation parameter values of current operation parameters. Based on one or more of the current operation parameters and current operation parameter values being different than the associated target operation parameters and target operation parameter values, the downlink command manager 126 may determine one or more operation parameter downlink commands 455 for the downhole tool to include in the downlink command sequence 447 for the downhole tool to implement the target operation parameter at the target operation parameter values. For example, the downlink command manager 126 may identify that the current operation parameters for the current state of the downhole tool are a toolface angle of 53° and a steering ratio of 75%. The downlink command may additionally identify that in order to achieve a target state 452 for an upcoming transition of the trajectory, the tool command 436 indicates target operation parameters of a toolface angle of 74° and a steering ratio of 75%. Accordingly, the downlink command manager 126 may select, from the candidate downlink commands 446, one or more operation parameter downlink commands 455 for including in the downlink command sequence 447 for changing the toolface angle from 53° to 74° and maintaining the steering ratio at 75%. In this way, the downlink command sequence 447 may facilitate implementing target operation parameters of the target state 452.

In some embodiments, the operation mode downlink command 454 may be a first downlink command in the downlink command sequence 447. For example, as described herein, each operation mode may have a specific set of operation parameters for implementing in connection with that operation mode, and the operation mode downlink command 454 may be a first downlink command in the downlink command sequence 447 in order to establish or implement the operation mode, for example, prior to implementing the specific operation parameters of the operation mode.

As mentioned above, the downhole tool may be configured to operate based on a limited number of downlink commands and/or downlinks. This may be due to the fact that communication with the downhole tool is achieved by sending signals encoded into surface parameters supplied to the downhole tool such as a flowrate or pressure of drilling fluid, or a rotational speed (RPM) of the drill string. Thus, in some embodiments, communication with the downhole tool, which may be located miles below the surface of the wellbore may be difficult, slow, rudimentary, and cumbersome. Accordingly, the number of available downlinks (and associated downlink commands) for communicating with the downhole tool may be limited. For instance, the downhole tool may be configured to communicate via 64 downlink IDs (e.g., for each operation mode) and associated downlink commands.

In some embodiments, the tool command 436 of the drill plan may indicate for the downhole tool to implement one or more operation parameters with operation parameter values that may not be possible to substantially achieve given the limited set of available downlink commands. To elaborate, in some cases a tool command of the drill plan may indicate certain operation parameter values for achieving one or more sections of the trajectory, but it may not be possible to communicate the exact operation parameter values to the downhole tool with the limited downlink commands for which the downhole tool is configured. As an illustrative example, a tool command may indicate to achieve a portion of the trajectory by implementing a tool face angle of 68°, but the downlink definitions may only include downlink commands for implementing a toolface angle of 45°, 54°, 72°, 90°, etc. (e.g., values that are not substantially 68°). Additionally, the downlink definitions may include downlink commands for implementing changes to the toolface angle of +12°, −12°, +20°, −20°, etc., such that, even so, a combination of downlink commands may not be able to achieve a toolface angle of substantially 68°.

In some embodiments, the downlink command manager 126 may generate the operation parameter downlink commands 455 by selecting one downlink command, or a combination of several, ordered downlink commands, of the candidate downlink commands 446 for approximating the target operation parameter value of a given target operation parameter. For example, for a tool command 436 that indicates a target operation parameter of a toolface angle of 130°, the downlink command manager 126 may select a downlink command for setting the toolface angle to 135°. In another example, the downlink command manager 126 may select a sequence of downlink commands including a downlink command for setting the toolface angle to 144° followed by a downlink command 455 for decreasing the toolface angle by 12°, resulting in a toolface angle of 132°.

In some embodiments, the downlink command manager 126 may select one downlink command, or a combination of downlink commands, that result in a closest value to the target operation parameter value. In some embodiments, the downlink command manager 126 may prioritize implementing fewer operation parameter downlink commands. For example, a combination of larger downlink commands 45 may arrive closer to a given operation parameter value than a combination of fewer (e.g., or a single) downlink commands, and the downlink command manager 126 may implement the smaller combination of downlink commands in order to minimize the amount of downlinks to send to the downhole tool. In some embodiments, the downlink command manager 126 may implement a less accurate but smaller combination of operation parameter downlink commands (e.g., a single downlink command) in this way based on the resulting operation parameter value being within a threshold of the target operation parameter value. In this way, the downlink command manager 126 may determine one or more operation parameters downlink commands 455 to include in the downlink command sequence 447 for approximating a target operation parameter of the tool command 436.

In some embodiments, the tool command 436 may indicate for the downhole tool to implement two or more operation parameters with associated operation parameter values that cannot be substantially achieved given the limited set of downlink commands. In such cases, the downlink command manager 126 may implement various techniques for determine one or more operation parameter downlink commands 445 for approximating each of the two or more operation parameter values.

As an example, the downlink command manager 126 may determine (e.g., from the downhole tool configuration, user input, etc.) an operation parameter that is most important, and may prioritize approximating the associated operation parameter value more closely than for other, less important operation parameters. In another example, the downlink command manager 126 may select the set of one or more operation parameter downlink commands that results in the closest approximations for all of the operation parameter values. For instance, the downlink command manager 126 may implement an optimization or minimization function such as linear, polynomial, or complex regression functions for determining a best-fit set of downlink commands.

In some embodiments, the downlink command manager 126 may select the operation parameters downlink command (s) 455 based on representing the two or more operation parameters in an n-dimensional space. For example, each of the target operation parameters of the tool command 436 may define a dimension in the n-dimensional space, and the downlink command manager 126 may represent each of the candidate downlink commands 446, and each possible combination of the candidate downlink commands 446 that are associated with those specific target operation parameters in the n-dimensional space. Thus, each possible combination of resulting operation parameter values for the combination of operation parameters may be represented in the n-dimensional space. Given a tool command 436 that indicates to implement a target combination of operation parameter values that is not substantially expressed by one of the possible combinations of resulting operation parameters values in the n-dimensional space, the downlink command manager 126 may determine which of all the possible operation parameter value combinations is closest to the target combination. For example, the downlink command manager 126 may determining a minimum distance between the target operation parameter value combination and the possible combinations. The downlink command manager 126 may implement any other suitable techniques for optimization, regression, minimization, etc. In this way, the downlink command manager 126 may choose a set of operation parameter downlink commands 455 that best approximates or represents target operation parameter values for a set of two or more target operation parameters.

In some embodiments, a relationship between two or more operation parameters that are to be implemented together may not be a linear relationship such that representing the relationship in a linear way and minimizing a (e.g., linear) distance to approximate the fit of each operation parameter may not be a suitable technique. For example, in some embodiments, one operation parameter may be more important or more highly weighted than another operation parameter. In another example, one operation parameter may influence another operation parameter, or in other words, one operation parameter (e.g., changing one operation parameter) may affect the way another operation parameter behaves or affects the downhole tool. In some embodiments, the downlink command manager 126 may represent a set of two or more operation parameters in a non-linear way, such as with respect to a non-linear space or coordinate system.

Figure 5:
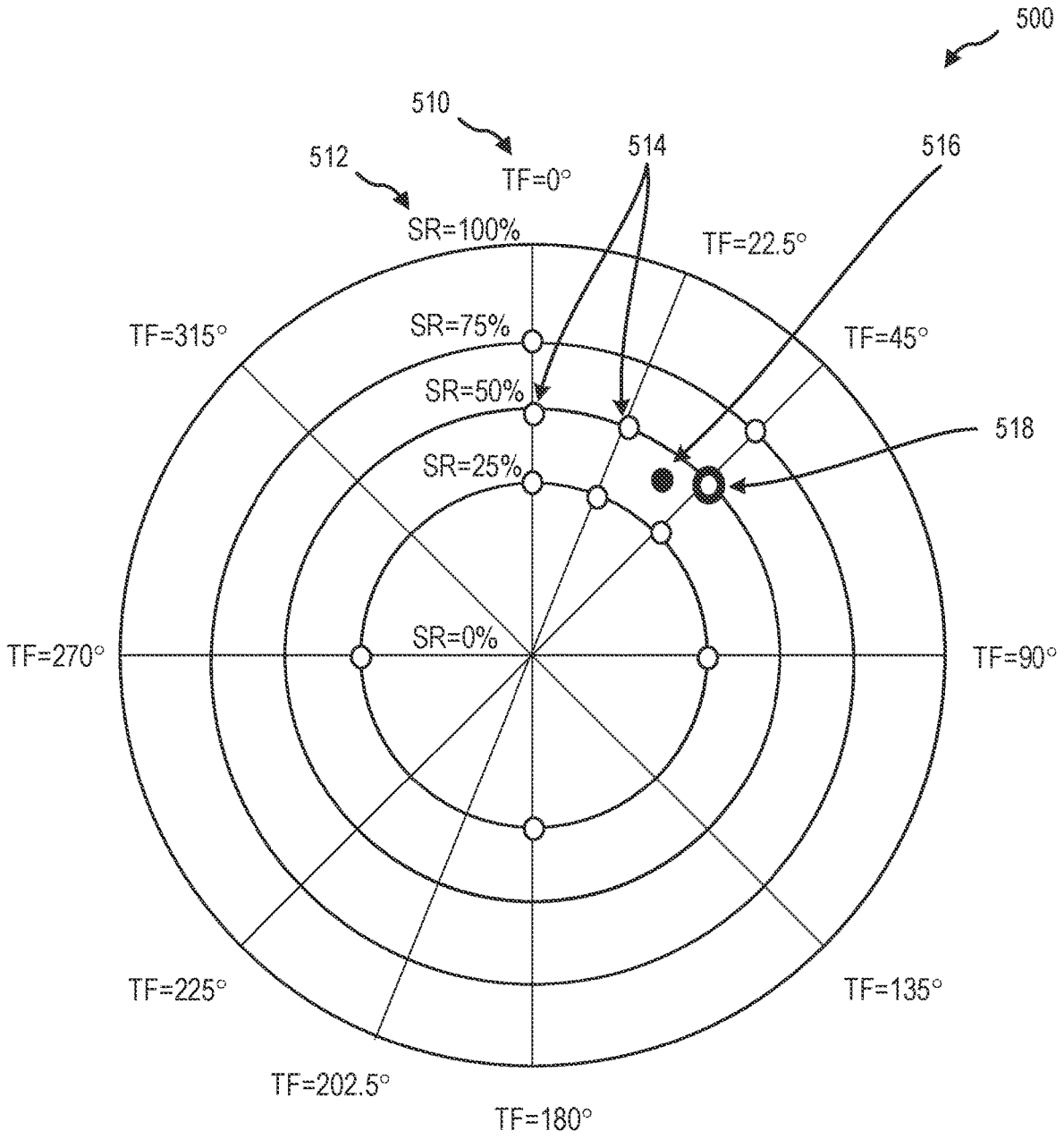
FIG. 5 illustrates an example representation of a downlink command manager determining an operation parameters downlink command, according to at least one embodiment of the present disclosure.

FIG. 5 illustrates an example representation of the downlink command manager 126 determining an operation parameter downlink command, according to at least one embodiment of the present disclosure. In some embodiments, the downlink command manager 126 represents a combination of two or more operation parameters that are to be implemented together by representing them in a complex number space 500. For example, the operation parameters of a toolface angle 510 and a steering ratio 512 may be implemented together, and the downlink command manager 126 may represent the toolface angle 510 as a first dimension and the steering ratio 512 as a second dimension of the complex number space 500. The relationship between the toolface angle 510 and the steering ratio 512 may be complex and/or non-linear in that an angular change in the toolface angle 510 may have a different effect on the steering tool at different steering ratios 512. For instance, the relationship between the variables and/or dimensions in the complex number space 500 may be described by the following relationship:

$$(TF,SR)\rightarrow SR\cdot e^{iTF}$$

for the dimensions of toolface angle (TF) and Steering ratio (SR).

The downlink command manager 126 may represent this complex relationship with a circular compass-style space, or any other form of coordinate system. The dimensions of the complex number space 500 may be any other dimensions or variables, and may be related based on any other relationship.

The downlink command manager 126 may represent each possible combination of operation parameter values for the toolface angle 510 and steering ratio 512 (e.g., resulting from each possible downlink command or combination of downlink commands from the candidate downlink commands) in the complex number space 500 as a plurality of candidate combinations 514 of operation parameter values. Based on a given tool command, the downlink command manager 126 may represent a target combination 516 of target operation parameter values in the complex number space 500. The downlink command manager 126 may select a final combination 518 of operation parameter values to approximate the target combinations 516 based on selecting a candidate combination 514 that is closest to the target combination 516. For example, the downlink command manager 126 may determine which candidate combination 514 has a shortest polar or complex distance to the target combination 516. The downlink command manager 126 may implement any other technique for optimizing or selecting a best-fit candidate combination 514. Based on the final combination 518, the downlink command manager 126 may determine the downlink command, or sequence of downlink commands, which may be implemented in order to achieve the final combination 518.

In some embodiments, the downlink command manager 126 may implement artificial intelligence (AI) for determining a downlink command sequence. For example, the downlink command manager 126 may utilize an AI planning workflow for determining the downlink command sequence. To elaborate, the downlink command manager 126 may be implemented in a planning domain description language (PDDL) that describes various aspects of the downhole system and/or the downhole tool, and defines the candidate downlink commands 446, as well as the current state and the target state of the downhole tool. An AI planning engine may find the optimal downlink command sequence from the candidate downlink commands in order to execute the tool command.

In some embodiments, the downlink command manager 126 may implement a machine learning model for determining the downlink command sequence. For example, the downlink command manager 126 may use one or more downlink generation machine learning models to generate a downlink command sequence. The downlink generation machine learning models may include different types of downlink generation neural networks, such as classification machine learning models with neural network architectures (e.g., Monte Carlo dropout prediction model, transformer-based models, large generative model-based segmentation neural networks, etc.).

For example, the downlink generation machine learning model may receive a current state and a target state of the downhole tool as inputs (e.g., input states), and may be trained to classify the target state based on the set of candidate downlink commands in order to generate a downlink command sequence that best represents or approximates the tool commands of the target state. To elaborate, the downlink generation machine learning model may be a convolutional neural network (CNN) that includes several neural network layers, such as lower neural network layers that form an encoder, and higher neural network layers that form a decoder. For example, the encoder may map or encode aspects of the target state and current state into feature vectors (i.e., latent object feature maps or latent object feature vectors) by processing each input state through various neural network layers (e.g., convolutional, ReLU, and/or pooling layers) to encode data, measurements, parameters, etc., related to the input states into feature vectors (e.g., a string of numbers in vector space representing the encoded image data). For instance, the encoder of the downlink generation machine learning model may process data associated with the target and input states to encode features corresponding to operation mode and operation parameters from the input states. The downlink generation machine learning model may incorporate other data, measurements, properties, etc., associated with the current and target states such as downhole or surface measurements, formation properties, trajectory measurements, or any other associated data in order to learn relationships between these data and a resulting downlink command sequence.

Additionally, in various implementations, the downlink generation machine learning model includes higher neural network layers that form a decoder, which may include fully connected layers and/or a classifier function (e.g., a SoftMax or a sigmoid function). In these implementations, the decoder processes the feature vectors to decode detected relationships in an encoded state vector and generates a downlink command sequence for approximating the target state. The downlink generation machine learning model may often be trained offline but may be trained on the fly.

In this way, the downlink command manager 126 may implement a downlink generation machine learning model that may be trained to determine a downlink command sequence for approximating a tool command, including an operation mode downlink command and/or operation parameter downlink commands in order to achieve a target state for the downhole tool.

Figure 6:
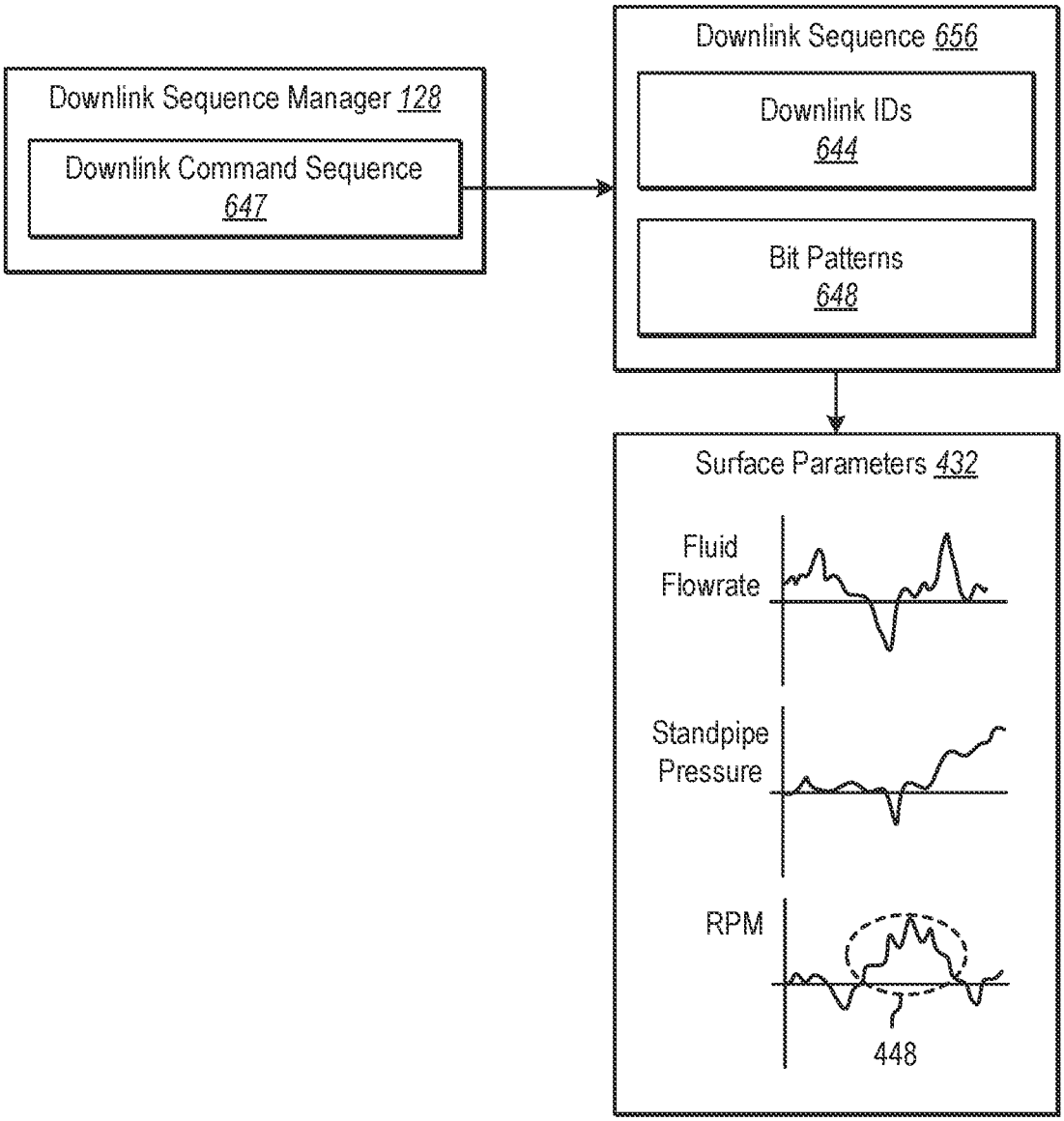
FIG. 6 illustrates example features and functionalities of a downlink sequence manager, according to at least one embodiment of the present disclosure.

As mentioned above, the downlink generation system 120 includes a downlink sequence manager 128. The downlink sequence manager 128 may determine a sequence of one or more downlinks for communicating to the downhole tool. FIG. 6 illustrates example features and functionalities of the downlink sequence manager 128.

The downlink sequence manager 128 may receive a downlink command sequence 647 of one or more downlink commands for instructing the downhole tool to implement a specific operation mode and/or operation parameters as described herein. Based on the downlink command sequence 647, the downlink sequence manager 128 may determine a corresponding downlink sequence 656 of one or more downlinks. For example, based on the specific downlink commands of the downlink command sequence 647, the downlink sequence manager 128 may identify which downlink IDs 644 (and an associated sequence or order for the downlink IDs 644) to communicate to the downhole tool in order to implement the associated downlink command sequence 647.

In some embodiments, the downlink sequence manager 128 may identify associated bit patterns 648 for the downlink sequence 656 to communicate the downlink IDs 644 to the downhole tool. For example, based on the downlink definitions, the downhole tool may identify and/or generate a bit pattern or a sequence of several bit patterns for communicating the associated downlink sequence (e.g., the downlink IDs 644) to the downhole tool.

In some embodiments, the downlink sequence manager may facilitate encoding the bit patterns 648 into one or more surface parameters 432. For example, the downlink sequence manager 128 may provide the downlink sequence 656 to facilitate modulating one or more of a fluid flowrate, a standpipe pressure, or an RPM provided at the surface of the wellbore to the downhole tool. In this way, the downhole tool may receive the downlink sequence 656 through the surface parameters 432 and interpret the downlink sequence 656 in order to implement the downlink commands of the downlink command sequence 647.

Figure 7:
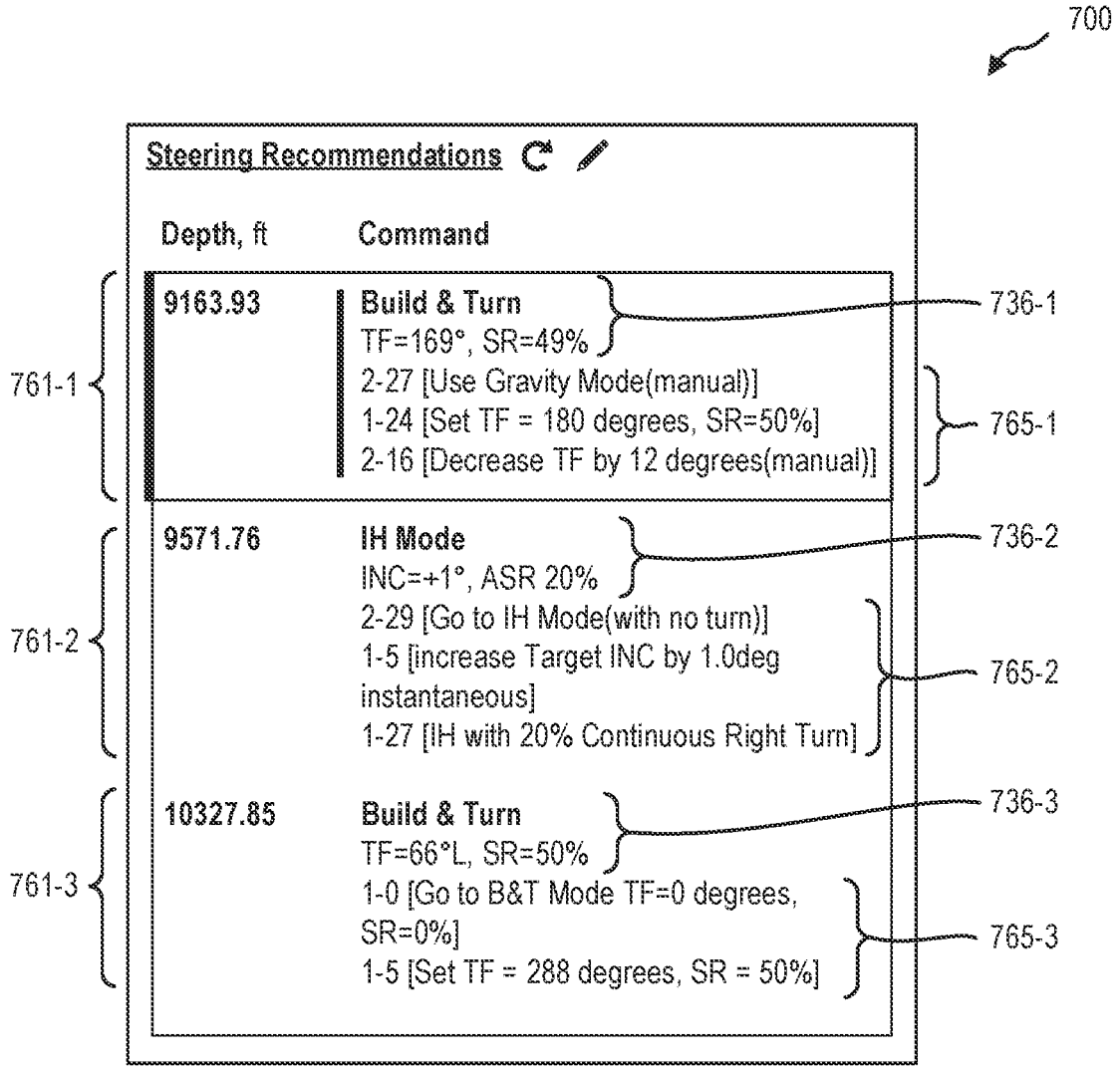
FIG. 7 illustrates an example implementation of the downlink generation system as described herein, according to at least one embodiment of the present disclosure.

FIG. 7 illustrates an example implementation 700 of the downlink generation system 120 as described herein, according to at least one embodiment of the present disclosure.

The downlink generation system 120 may generate a first downlink sequence 765-1 associated with a first section 761-1 of a wellbore trajectory. The first section 761-1 may be a portion of the wellbore from about 9100 ft to about 9500 ft. A first tool command 736-1 may indicate a target operation mode of "Build and Turn" with associated target operation parameters of a toolface angle of 169° to the right (e.g., 169° in a positive direction) and a steering ratio of 49% in order to achieve the first section 761-1 of the trajectory. Accordingly, the downlink generation system 120 may determine the first downlink sequence 765-1 based on a sequence of downlink commands and associated downlink IDs for executing the first tool command 736-1. For example, the downlink generation system 120 may determine that the operation mode of the downhole tool is already set to "Build and Turn" and may accordingly not include a downlink command in the downlink sequence 765-1 for instructing the downhole tool to implement the "Build and Turn" mode. The first downlink sequence 765-1 may indicate for the tool to set a toolface mode for the toolface to "gravity mode" based on a downlink ID of 2-27. Further the first downlink sequence 765-1 indicates for the downhole tool to achieve the target operation parameters of the first tool command 736-1 based on a sequence of downlink commands to set the toolface angle to 180° and the steering ratio to 50% (downlink ID 1-24) and then decrease the toolface angle by 12° (downlink ID 2-16) resulting in a toolface angle of 168°. In this way, the downlink generation system 120 may generate the first downlink sequence 765-1 which may approximate the first tool command 736-1.

The downlink generation system 120 may generate a second downlink sequence 765-2 associated with a second section 761-2 of a wellbore trajectory. The second section 761-2 may be a portion of the wellbore from about 9500 ft to about 10300 ft. A second tool command 736-2 may indicate a target operation mode of "IH" with associated target operation parameters of a target inclination of +1° and an azimuthal steering ratio of 20% in order to achieve the second section 761-2 of the trajectory. Accordingly, the downlink generation system 120 may determine the second downlink sequence 765-2 based on a sequence of downlink commands and associated downlink IDs for executing the second tool command 736-2. For example, the second downlink sequence 765-2 indicates for the tool to set the operation mode to "IH" based on a downlink ID of 2-27. Further the first downlink sequence indicates for the downhole tool to achieve the target operation parameters of the second tool command 736-2 based on a sequence of downlink commands to increase the target inclination by 1° (downlink ID 1-5) and then implement a 20% continuous right turn (downlink ID 1-29). In this way, the downlink generation system 120 may generate the second downlink sequence 765-2 which may substantially execute the second downlink command 736-2.

The downlink generation system 120 may generate a third downlink sequence 765-3 associated with a third section 761-3 of a wellbore trajectory. The third section 761-3 may be a portion of the wellbore from about 10300 ft and beyond. A third tool command 736-3 may indicate a target operation mode of "Build and Turn" with associated target operation parameters of a toolface angle of 66° to the left (e.g., 66° in the negative direction) and a steering ratio of 50% in order to achieve the third section 761-3 of the trajectory. Accordingly, the downlink generation system 120 may determine the third downlink sequence 765-3 based on a sequence of downlink commands and associated downlink IDs for executing the third tool command 736-3. For example, the third downlink sequence 765-3 indicates for the tool to set the operation mode to "Build and Turn" based on a downlink ID of 1-0. The third downlink sequence 765-3 indicates for the tool to set a toolface mode for the toolface to "gravity mode" based on a downlink ID of 2-27. Further the third downlink sequence 765-3 indicates for the downhole tool to achieve the target operation parameters of the third tool command 736-3 based on a downlink command to set the toolface angle to 288° and the steering ratio to 50% (downlink ID 1-5) resulting in a toolface angle of 72° to the left. In this way, the downlink generation system 120 may generate the third downlink sequence 765-3 which may approximate the third downlink command 736-3.

Figure 8:
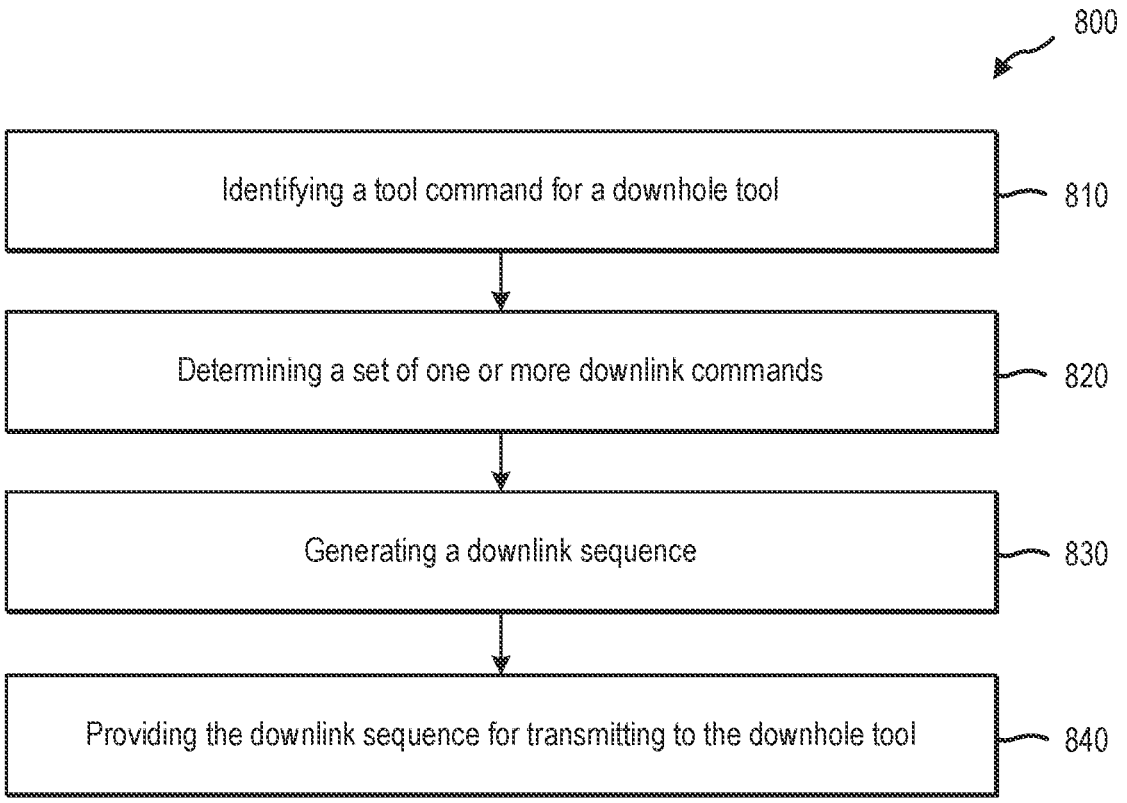
FIG. 8 illustrates a flow diagram for a method or a series of acts for implementing an operation of a downhole tool within a wellbore as described herein, according to at least one embodiment of the present disclosure.

FIG. 8 illustrates a flow diagram for a method 800 or a series of acts for implementing an operation of a downhole tool within a wellbore as described herein, according to at least one embodiment of the present disclosure. While FIG. 8 illustrates acts according to one embodiment, alternative embodiments may add to, omit, reorder, or modify and of the acts of FIG. 8. The acts of FIG. 8 can be performed as part of a method. Alternatively, a non-transitory computer-readable medium can include instructions that, when executed by one or more processors, cause a computing device to perform the acts of FIG. 8. In still further embodiments, a system can perform the acts of FIG. 8.

In some embodiments, the method 800 includes an act 810 of identifying a tool command for a downhole tool. More specifically, the act 810 may include identifying a tool command for a downhole tool to change a current state of the downhole tool to a target state. For example, the current state of the downhole tool may include an operation mode of the downhole tool and a set of operation parameters with associated operation parameter values for the operation mode. In some embodiments, the downhole tool is a steering tool and the tool command indicates to change the current state based on changing one or more of a steering mode of the downhole tool or a set of steering parameters with associated steering parameter values for the steering mode. The tool command may indicate to change the current state based on changing one or more of the operation mode or the set of operation parameters. For example, the tool command may be associated with steering the steering tool in a non-vertical orientation.

In some embodiments, the method 800 includes an act 820 of determining a set of one or more downlink commands. More specifically, the act 820 may include determining, from a set of candidate downlink commands, a set of one or more downlink commands associated with executing the tool command. In some embodiments, the target state cannot be achieved by any single candidate downlink command of the set of candidate downlink commands, and determining the set of one or more downlink commands includes determining a combination of two or more candidate downlink commands for executing the tool command. In some embodiments, the target state cannot be achieved by combinations of one or more candidate downlink commands of the set of candidate downlink commands, and the set of one or more downlink commands is determined based on being the closest among the combinations of one or more candidate downlink commands.

In some embodiments, the tool command indicates for the downhole tool to implement a target operation parameter with a target operation parameter value, and the set of one or more downlink commands includes a sequence of downlink commands that instructs the downhole tool to execute the tool command based on a first downlink command indicating for the downhole tool to implement the target operation parameter with a first operation parameter value, wherein the first operation parameter value is not the target operation parameter value a second downlink command indicating for the downhole tool to change the first operation parameter value by a second value to implement a final operation parameter value for the first operation parameter. In some embodiments, the final operation parameter value is the target operation parameter values. In some embodiments, the final operation parameter value is not the target operation parameter value, and the sequence of downlink commands is determined based on the final operation parameter value being closest to the target operation parameter value among operation parameter values from any combination of one or more candidate downlink commands of the set of candidate downlink commands.

In some embodiments, the current state of the downhole tool includes a first operation mode of the downhole tool and first operation parameters with associated first operation parameter values for the first operation mode, and the tool command indicates for the downhole tool to implement a second operation mode and second operation parameters with associated target operation parameter values for the second operation mode, and wherein the set of one or more downlink commands includes a sequence of downlinks including a first one or more downlinks indicating for the downhole tool to implement the second operation mode, and a second one or more downlinks indicating for the downhole tool to implement the second operation parameters with associated second operation parameter values. In some embodiments, the second operation parameter values are not the target operation parameter values, and the set of one or more downlink commands are determined based on the second operation parameter values being closest to the target operation parameter values among operation parameter values from any combination of one or more candidate downlink commands of the set of candidate downlink commands.

In some embodiments, the tool command indicates for the downhole tool to implement a target set of operation parameters including a first target operation parameter value for a first operation parameter and a second target operation parameter value for a second operation parameter, and wherein determining the set of one or more downlink commands includes representing the target set of operation parameters and a set of candidate downlink command combinations in a complex number space and selecting a downlink command combination from the set of candidate downlink command combinations based on a complex distance between the downlink command combination and the target set of operation parameters. In some embodiments, a behavior effect or behavior characteristic of the first operation parameters on the downhole tool is dependent on the second operation parameter. For example, the first operation parameter may be a toolface angle and the second operation parameter may be a steering ratio.

In some embodiments, the set of one or more downlink commands is determined by a downlink generation machine learning model trained to classify the tool command based on the set of candidate downlink commands, and the set of one or more downlink commands is selected based on having a highest probability of achieving the target state among all combinations of one or more candidate downlink commands of the set of candidate downlink commands.

In some embodiments, the method 800 includes an act 830 of generating a downlink sequence. More specifically, the act 830 may include generating a downlink sequence of one or more downlinks for communicating the set of one or more downlink commands to the downhole tool.

In some embodiments, the method 800 includes an act 840 of providing the downlink sequence for transmitting to the downhole tool. For example, the downlink sequence may be transmitted to the downhole tool based on encoding the downlink sequence into one or more surface parameters provided to the downhole tool from the surface of the wellbore. In some embodiments, the downhole tool executes the set of one or more downlink commands to change the current state of the downhole tool.

Figure 9:
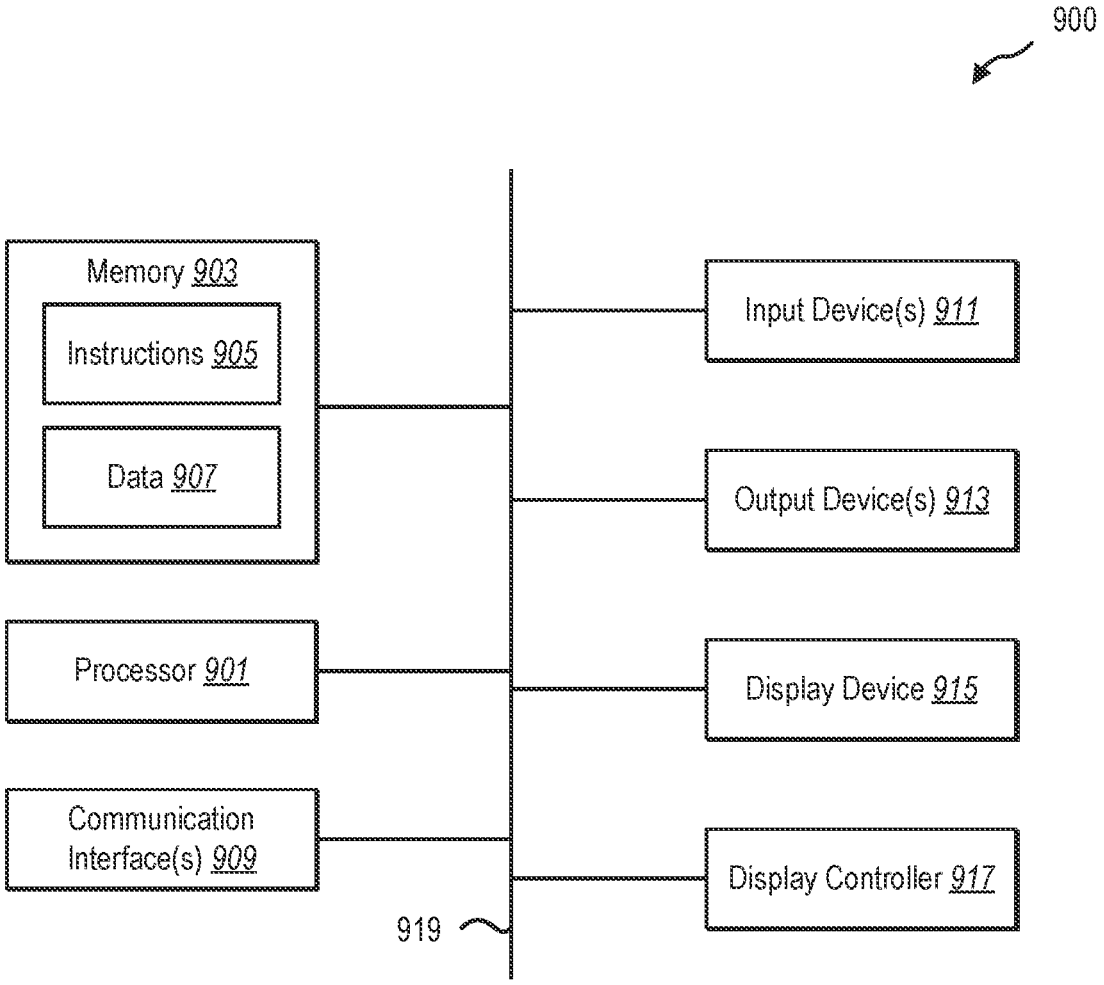
FIG. 9 illustrates certain components that may be included within a computing system.

Turning now to FIG. 9, this figure illustrates certain components that may be included within a computer system 900. One or more computer systems 900 may be used to implement the various devices, components, and systems described herein.

The computer system 900 includes a processor 901. The processor 901 may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 901 may be referred to as a central processing unit (CPU). Although just a single processor 901 is shown in the computer system 900 of FIG. 9, in an alternative configuration, a combination of processors (e.g., an ARM and DSP) could be used.

The computer system 900 also includes memory 903 in electronic communication with the processor 901. The memory 903 may include computer-readable storage media and can be any available media that can be accessed by a general purpose or special purpose computer system. Computer-readable media that store computer-executable instructions are non-transitory computer-readable media (device). Computer-readable media that carry computer-executable instructions are transmission media. Thus, by way of example and not limitations, embodiment of the present disclosure can comprise at least two distinctly different kinds of computer-readable media: non-transitory computer-readable media (devices) and transmission media.

Both non-transitory computer-readable media (devices) and transmission media may be used temporarily to store or carry software instructions in the form of computer readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which can be used to store program code in the form of computer-executable instructions or data structures and which can be accessed by a general purpose or special purpose computer, whether such program code is stored or in software, hardware, firmware, or combinations thereof.

Instructions 905 and data 907 may be stored in the memory 903. The instructions 905 may be executable by the processor 901 to implement some or all of the functionality disclosed herein. Executing the instructions 905 may involve the use of the data 907 that is stored in the memory 903. Any of the various examples of modules and components described herein may be implemented, partially or wholly, as instructions 905 stored in memory 903 and executed by the processor 901. Any of the various examples of data described herein may be among the data 907 that is stored in memory 903 and used during execution of the instructions 905 by the processor 901.

A computer system 900 may also include one or more communication interfaces 909 for communicating with other electronic devices. The communication interface(s) 909 may be based on wired communication technology, wireless communication technology, or both. Some examples of communication interfaces 909 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

The communication interfaces 909 may connect the computer system 900 to a network. A "network" or "communications network" may generally be defined as one or more data links that enable the transport of electronic data between computer systems and/or modules, engines, or other electronic devices, or combinations thereof. When information is transferred or provided over a communication network or another communications connection (either hardwired, wireless, or a combination of hardwired or wireless) to a computing device, the computing device properly views the connection as a transmission medium. Transmission media can include a communication network and/or data links, carrier waves, wireless signals, and the like, which can be used to carry desired program or template code means or instructions in the form of computer-executable instruction or data structures and which can be accessed by a general purpose or special purpose computer.

A computer system 900 may also include one or more input devices 911 and one or more output devices 913. Some examples of input devices 911 include a keyboard, mouse, microphone, remote control device, button, joystick, trackball, touchpad, and lightpen. Some examples of output devices 913 include a speaker and a printer. One specific type of output device that is typically included in a computer system 900 is a display device 915. Display devices 915 used with embodiments disclosed herein may utilize any suitable image projection technology, such as liquid crystal display (LCD), light-emitting diode (LED), gas plasma, electroluminescence, or the like. A display controller 917 may also be provided, for converting data 907 stored in the memory 903 into one or more of text, graphics, or moving images (as appropriate) shown on the display device 915.

The various components of the computer system 900 may be coupled together by one or more buses, which may include one or more of a power bus, a control signal bus, a status signal bus, a data bus, other similar components, or combinations thereof. For the sake of clarity, the various buses are illustrated in FIG. 9 as a bus system 919.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures can be transferred automatically or manually from transmission media to non-transitory computer-readable storage media (or vice versa). For example, computer executable instructions or data structures received over a network or data link can be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media can be included in computer system components that also (or even primarily) utilize transmission media.

INDUSTRIAL APPLICABILITY

In some embodiments, a downhole system is described for drilling an earth formation to form a wellbore. The downhole system includes a drill rig used to turn a drilling tool assembly which extends downward into the wellbore. The drilling tool assembly may include a drill string, a bottomhole assembly ("BHA"), and a bit, attached to the downhole end of the drill string.

The drill string may include several joints of drill pipe connected end-to-end through tool joints. The drill string transmits drilling fluid through a central bore and transmits rotational power from the drill rig to the BHA. In some embodiments, the drill string further includes additional downhole drilling tools and/or components such as subs, pup joints, etc. The drill pipe provides a hydraulic passage through which drilling fluid is pumped from the surface. The drilling fluid discharges through selected-size nozzles, jets, or other orifices in the bit for the purposes of cooling the bit and cutting structures thereon, and for lifting cuttings out of the wellbore as it is being drilled.

The BHA may include the bit, other downhole drilling tools, or other components. Examples of additional downhole tools include collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

The BHA may further include a rotary steerable system (RSS). The RSS may include directional drilling tools that change a direction of the bit, and thereby the trajectory of the wellbore. At least a portion of the RSS may maintain a geostationary position relative to an absolute reference frame, such as one or more of gravity, magnetic north, or true north. Using measurements obtained with the geostationary position, the RSS may locate the bit, change the course of the bit, and direct the directional drilling tools on a projected trajectory. The RSS may be implemented to direct the bit in accordance with or based on a trajectory for the bit. For example, a trajectory may be determined for directing the bit toward one or more subterranean targets such as an oil or gas reservoir. The RSS may be controlled in accordance with commands or instructions, for example, transmitted to the RSS via downlinks from the surface of the wellbore. Through downhole telemetry techniques, the RSS may communicate various information back to the surface.

The downhole system may include or may be associated with a client device with a downlink generation system implemented thereon (e.g., implemented on one, several, or across multiple client devices). The downlink generation may facilitate determining, generating, and/or transmitting downlinks to the RSS (or other downhole tools) to control the RSS.

The downhole system may include or may be associated with one or more client devices with a downlink generation system implemented thereon (e.g., implemented on one, several, or across multiple client devices). The downlink generation system may facilitate calculating and/or assessing forces and/or other parameters that may act on the drill string in association with the drill string advancing into or being retrieved from the wellbore.

In some embodiments, a downlink generation system is implemented in example environment in accordance with one or more embodiments describe herein. In some embodiments, the example environment includes one or more server device(s). The server device(s) may include one or more computing devices (e.g., including processing units, data storage, etc.) organized in an architecture with various network interfaces for connecting to and providing data management and distribution across one or more client systems. The server devices may be connected to and may communicate with (either directly or indirectly) one or more client devices through a network. The network may include one or multiple networks and may use one or more communication platforms and/or technologies suitable for transmitting data. The network may refer to any data link that enables transport of electronic data between devices of the environment. The network may refer to a hardwired network, a wireless network, or a combination of a hardwired network and a wireless network. In one or more embodiments, the network includes the internet. The network may be configured to facilitate communication between the various computing devices via well-site information transfer standard markup language (WITSML) or similar protocol, or any other protocol or form of communication.

The client device may refer to various types of computing devices. For example, one or more client devices may include a mobile device such as a mobile telephone, a smartphone, a personal digital assistant (PDA), a tablet, a laptop, or any other portable device. Additionally, or alternatively, the client devices may include one or more non-mobile devices such as a desktop computer, server device, surface or downhole processor or computer (e.g., associated with a sensor, system, or function of the downhole system), or other non-portable device. In one or more implementations, the client devices include graphical user interfaces (GUI) thereon (e.g., a screen of a mobile device). In addition, or as an alternative, one or more of the client devices may be communicatively coupled (e.g., wired or wirelessly) to a display device having a graphical user interface thereon for providing a display of system content. The server device(s) may similarly refer to various types of computing devices. Each of the devices of the environment may include features and/or functionalities described below.

The environment may include a downlink generation system implemented on one or more computing devices. The downlink generation system may be implemented on one or more client device, server devices, and combinations thereof. Additionally, or alternatively, the downlink generation system may be implemented across the client devices and/or the server devices such that different portions or components of the downlink generation system are implemented on different computing devices in the environment. In this way, the environment may be a cloud computing environment, and the downlink generation system may be implemented across one or more devices of the cloud computing environment in order to leverage the processing capabilities, memory capabilities, connectivity, speed, etc., that such cloud computing environments offer in order to facilitate the features and functionalities described herein.

In some embodiments, an example implementation of the downlink generation system is described herein, according to at least one embodiment of the present disclosure.

The downlink generation system may include a data manager, a downhole model engine for generating a downhole model, and a simulation engine. The downlink generation system may also include a data storage having bit geometry data, operational parameter data, bit behavior characteristics, and formation data stored thereon. While one or more embodiments described herein describe features and functionalities performed by specific components of the downlink generation system, it will be appreciated that specific features described in connection with one component of the downlink generation system may, in some examples, be performed by one or more of the other components of the downlink generation system.

By way of example, one or more of the data receiving, gathering, or storing features of the drill plan manager may be delegated to other components of the downlink generation system. As another example, while sequences of downlinks may be generated by the downlink sequence manager, in some instances, some or all of these features may be performed by the downlink command manager (or other component of the downlink generation system). Indeed, it will be appreciated that some or all of the specific components may be combined into other components and specific functions may be performed by one or across multiple components of the downlink generation system.

Additionally, the downlink generation system has been described as implemented on a client device of the downhole system, it should be understood that some or all of the features and functionalities of the downlink generation system may be implemented on or across multiple client devices and/or server devices. For example, data may be input and/or received by the data manager on a (e.g., local) client device, and the downhole model may be generated and/or simulated on one or more of a remote, server, or cloud device. Indeed, it will be appreciated that some or all of the specific components may be implemented on or across multiple client devices and/or server devices, including individual functions of a specific component being performed across multiple devices.

The downlink generation system may facilitate communicating commands to a downhole tool via downlinks sent from the surface. For example, the downhole tool may be a steering tool and the downlink generation system may facilitate communicating steering commands to the steering tool in order that the steering tool may direct the drill string toward, around, or to one or more underground features. It should be understood, however, the downlink generation system and the techniques described herein may be applicable to any tool implemented downhole such as, for example, measurement (MWD) tools, logging (LWD) tools, drilling tools, or any other downhole tool.

As mentioned above, the downlink generation system includes a drill plan manager. The drill plan manager may receive a variety of types of data associated with the downhole system and may store the data to the data storage. The drill plan manager may receive the data from a variety of sources, such as from sensors, surveying tools, downhole tools, other (e.g., client) devices, libraries, databases, user input, etc.

In some embodiments, the drill plan manager receives a drill plan. The drill plan may indicate or outline a plan for various aspects of the wellbore. The drill plan may be generated as part of a planning phase of the wellbore, and may be updated one or more times throughout the construction, implementation, and operation of the wellbore. The drill plan manager may maintain and update the drill plan as it is planned and/or becomes available. For example, the drill plan manager may receive, in real time, any of the data described herein, including real time updates to the drill plan. This may facilitate the downlink generation system performing the downlink determination and generation techniques described herein in real time. For instance, the downlink generation system may determine a sequence of one or more downlinks to transmit to the downhole tool in real time as the wellbore is being drilled and as certain tool commands are indicated in the drill plan to be applied. In another example, the downlink generation system may determine some or all of the downlink sequences ahead of time (e.g., for the whole trajectory) as the drill plan is updated.

In some embodiments, the drill plan includes information related to a trajectory 134, or a path for the downhole tool to follow from a hole bottom (HB) to reach a target, such as an underground reservoir. The trajectory may exhibit a 2- or 3-dimensional geometry for the downhole tool to traverse. The drill plan may indicate one or more tool commands for the downhole tool to implement in order to achieve the trajectory. For example, in order to achieve the (e.g., complex geometry of) trajectory, the trajectory may be segmented into various sections. The trajectory may have example sections $u_0$-$u_3$ with transitions T1-T3 therebetween. The trajectory may be divided into the sections based on a specific operation mode and/or operation parameters for the downhole tool to implement at associated measurement depths in order to achieve the desired geometry for each section of the trajectory. For example, the drill plan may indicate the tool commands corresponding to the sections $u_0$-$u_3$ and/or transitions T1-T3. In some embodiments, the tool commands indicate a specific operation mode for the downhole tool to implement for a corresponding section (e.g., beginning at the associated transition). In some embodiments, the tool commands indicate specific operation parameters for the operation mode for the downhole tool to implement at associated operation parameters values.

As an illustrative example, the drill plan may indicate that a first transition T1 between an initial or active section u0 and a first section u1 occurs as a measurement depth of around 9,100 ft. The tool commands may indicate for the downhole tool to achieve the first section u1 of the trajectory by implementing an operation mode of "Build and Turn" with operation parameters of a tool face angle of 169° and a steering ratio of 49% beginning at the first transition T1. The drill plan may indicate that a second transition T2 between the first section u1 and a second section u2 occurs at a measurement depth of around 9,900 ft. The tool commands may indicate for the downhole tool to achieve the second section u2 of the trajectory by implementing an operation mode "IH" (inclination hold as described herein) with operation parameters of increasing the target inclination by 1° and implementing an azimuthal steering ratio of 20% beginning at the second transition T2. Further, the drill plan may indicate that a third transition T3 between the second section u2 and a third section u3 occurs at a measurement depth of around 10,500 ft. The tool commands may indicate for the downhole tool to achieve the third section u3 by implementing an operation mode of "AC" (auto curve a described herein) with operation parameters of a dog leg severity of 8° per 100 ft and a toolface angle of 185° beginning at the third transition T3. In this way, the drill plan may indicate how the trajectory is to be achieved through the tool commands. The drill plan manager may receive and/or update the drill plan by accessing a database or other computing system, or through user input.

In some embodiments, the drill plan manager receives information related to the capabilities of the downhole tool. For example, the drill plan manager may receive or access a configuration or specification of the downhole tool. The configuration may be associated with a specific type, model, manufacturer, and/or firmware of the downhole tool. The configuration may indicate the various operation modes that the downhole tool is configured to implement, including the various operation parameters associated with a given operation mode. Additionally, the configuration may additionally indicate the specific operation parameter values that the downhole tool may apply in order to implement each operation parameters. As described herein, the downhole tool may be configured to implement a finite, discrete, and/or limited number of operation parameters values for each operation parameters, and in some cases, a given operation parameter value indicated in the tool commands may not be achievable based on the (e.g., limited) configuration of the downhole tool.

As just mentioned, the configuration may indicate the operation modes for the downhole tool. In one example, the downhole tool may be configured for a manual or "Build and Turn" mode (e.g., manual steering mode). The "Build and Turn" mode may operate based on operation parameters such as one or more of: a toolface mode (e.g., gravity toolface mode, magnetic toolface mode, etc.), a toolface angle (with respect to a coordinate system defined by the toolface mode), or a steering ratio. The "Build and Turn" mode may be a manual or open loop mode in that the downhole tool may not make automatic adjustments or changes, but rather may operate, for example, in accordance with the specific toolface angle, toolface mode, and steering ratio indicated by the associated operation parameters.

In various examples, the downhole tool may operate in one or more automatic, or closed-loop modes in which the downhole tool may automatically implement changes or adjustments in accordance with the mode and in accordance with associated operation parameters. In one example, the downhole tool may be configured for an automatic vertical mode in which the downhole tool will automatically maintain a vertical or downward orientation. In another example, the downhole tool may be configured for an automatic "inclination hold" (IH) mode in which the downhole tool may maintain a given inclination. The IH mode may operate based on operation parameters such as one or more of: a target inclination, an inclination nudge size, or an azimuthal steering ratio. In another example, the downhole tool may be configured for an automatic "inclination and azimuth hold" (HIA) mode in which the downhole tool may maintain a given inclination and a given azimuth for tangents and laterals. The "HIA" mode may operate based on operation parameters such as one or more of: a target inclination, an inclination nudge size, a target azimuth, or an azimuth nudge size. In another example, the downhole tool may be configured for an automatic "auto curve" (AC) mode in which the downhole tool may automatically execute a curve of a given size and orientation. The "AC" mode may operate based on operation parameters such as one or more of: a dog leg severity or a toolface mode. In this way, the downhole tool configuration may indicate various operations that the downhole tool can perform based on the various modes in which it can operate. The downhole tool may be configured to implement any other operation mode and may be configured to change between different operation modes.

In some embodiments, the configuration may include instructions for communicating with the downhole tool. For example, the downhole tool may be configured to implement the operation modes and associated operation parameters based on signals or downlinks received by the downhole tool from the surface. The configuration may include a set of downlink definitions that define various downlinks (e.g., including downlink IDs, downlink commands, and bit patterns) for transmitting to the downhole tool in order to implement and/or change the operation mode and/or operation parameters (and associated operation parameter values) of the downhole tool. The drill plan manager may access the downlink definitions, for example, by receiving and/or loading a file describing the set of available downlinks for the downhole tool. For instance, the file may be a Json or xml file, or any other format for which the downlink definitions can be stored, retrieved and/or accessed. The drill plan manager 122 may access the downhole definitions, for example, from a cloud server (e.g., via the network 116 and/or server device 114).

In some embodiments, the downhole tool may be configured to communicate via a finite number of discrete, unique downlinks, such as 32 discrete downlinks, 64 discrete downlinks, 128 discrete downlinks, or any other discrete number of downlinks. The downlinks may be identifiable by a unique downlink ID. The downlink ID may be a code or combination of one or more integer numbers that, when received, can be translated (e.g., based on the downlink definitions) to indicate an associated downlink command. The downlink command may be a specific set of instructions for the downhole tool to implement, such as implementing a specific operation mode or operation parameters (with associated operation parameter values). A downlink may be communicated to the downhole tool through an associated bit pattern.

In some embodiments, the downlink command for a given downlink ID may instruct the downhole tool to implement a specific operation mode. For example, a downlink having a downlink ID of "2-20" may indicate to the downhole tool to implement or change to an operation mode of "Build and Turn". A downlink (and associated downlink command) may instruct the downhole tool to implement or change to any operation mode as described herein. For example, a downlink may instruct the downhole tool to change to an operation mode of "IH," "HIA," or "AC," or any other operation mode of the downhole tool. In this way, one or more downlinks may be associated with implementing a specific operation mode.

In some embodiments, the downlink command may instruct the downhole tool with respect to one or more specific operation parameters. For example, the downlink command may instruct the downhole tool to implement one or more operation parameters with specific operation parameter values. For instance, a downlink having a downlink ID of "1-1" may indicate to the downhole tool to implement a toolface angle of 0° and a steering ratio of 50%. In another example, the downlink command may instruct the downhole tool to implement a change to one or more operation parameter values of a certain degree or amount. For instance, a downlink having a downlink ID of "2-3" may indicate to the downhole tool to increase the toolface angle by 6°. In this way, the downhole tool may implement operation parameters with specific operation parameters values based on the downlink commands communicated to the downhole tool via downlinks.

A downlink (and associated downlink command) may instruct the downhole tool with respect to any operation parameter for the downhole tool and for any operation mode of the downhole tool. For example, a downlink may instruct the downhole tool to implement a (or an amount of change to a) specific inclination angle, dogleg severity, rate of penetration (ROP), or any operation parameter value as described herein. Additionally, the downlink command may instruct the downhole tool to implement a (or an amount of change to a) specific operation parameter value for a given amount of time, distance, angle, percent or until a desired quantity or value is otherwise obtained. In this way, the downhole tool may operate based on the downlink commands associated with the downlinks.

As mentioned above, the downlinks may be transmitted to the downhole tool based on an associated bit pattern. For example, a downlink may be encoded into one or more surface parameters (e.g., flow rate, pressure, rotational speed) supplied at the surface of the wellbore by modulating the surface parameters according to the defined bit pattern. The downhole tool may accordingly include sensors and/or componentry for detecting and identifying the bit pattern sent through the modulations of the surface parameters. In some embodiments, the configuration may indicate how to communicate the bit pattern by modulating the surface parameters. For example, bit pattern may be a binary encoding and the configuration may indicate how to modulate the surface parameters in order to encode the bit pattern into the surface parameters. For instance, the configuration may indicate how to implement certain values or changes in values (e.g., psi, RPM, gal/s, etc.) of the surface parameters and for certain time intervals in order to represent the various bits of the bit pattern.

In this way, based on a desired operation mode and/or desired operation parameters for the downhole tool to implement, a downlink ID (e.g., or a series or sequence of downlink IDs) may be selected, and the downlink ID may be communicated to the downhole tool by transmitting a downlink to the downhole tool as a bit pattern encoded into one or more surface parameters. The downhole tool may accordingly detect and interpret the bit pattern into the associated downlink ID in order to implement the associated downlink command for achieving the desired operation mode and/or desired operation parameter values.

A mentioned above, the downlink generation system includes a tool status manager. The tool status manager may determine and/or update a downhole tool status or a current state of the downhole tool. The state of the downhole tool may indicate the operation mode, operation parameters, and operation parameter values that the downhole tool is implementing, executing, or otherwise applying. For example, the tool status manager may receive an indication of the state via communications from the downhole tool, such as downhole telemetry communications received at the surface of the wellbore. In another example, the tool status manager may determine the state, for example based on one or more downlinks sent to the downhole tool. To elaborate, when one or more downlinks are sent to the downhole tool that indicate for the downhole tool to implement a specific mode and/or operation parameter values, the tool status manager may accordingly determine (or update) the state in order to reflect the downlink commands sent via the downlinks. In some embodiments, the tool status manager may verify the state based on confirming that the downhole tool received the downlinks that were sent from the surface, such as by comparing the downlink commands of the downlink with one or more downhole parameters that the downhole tool communicates (e.g., via downhole telemetry) to ensure that the downhole tool is implementing the changes in accordance with the downlink commands. In this way the tool status manager may determine a current state of the downhole tool.

The current state of the downhole tool may facilitate determining which downlinks to send to the downhole tool. For example, a tool command of the drill plan may indicate for a certain operation mode to be implemented, and the current status may indicate the current operation mode in order to determine whether a downlink needs to be sent to change the operation mode. As another example, in some embodiments downlink IDs may be dependent on a specific operation mode of the downhole tool. For instance, a downlink ID of "2-5" may signify a first downlink command for a first operation mode, and the same downlink ID of "2-5" may signify a second, different downlink command for a second operation mode. The current status may accordingly inform what downlink command corresponding to a give downlink ID. In another example, as described herein one or more downlink commands may be associated with changing (e.g., increasing or decreasing) an operation parameter value in contrast to, for example, implementing a specific operation parameter value. Accordingly, the current status may inform what downlink commands to implement in order achieve a given operation parameter value.

In some embodiments, the tool status manager may determine a desired, goal, or target state for the downhole tool. For example, based on the drill plan (and one or more depth measurements received from the downhole system) the tool status manager may determine a current location (e.g., depth) for the wellbore and/or downhole tool. For instance, the tool status manager may determine at what measurement depth the hole bottom of the wellbore is currently located. In some embodiments, the tool status manager may determine, based on the drill plan, the section and/or transition (and associated tool commands) of the trajectory that may actively (or next) apply to the current location of the downhole tool and/or of the wellbore hole bottom (e.g., the current state). Accordingly, the tool status manager may determine a next transition and/or next section of the trajectory and may determine the corresponding tool commands to implement for the next trajectory section. In this way, the next tool command may inform the target state that the tool status manager determines. The target state in this way may facilitate identifying a sequence of one or more downlink commands and associated downlinks to send to the downhole tool, as described herein.

As mentioned above, the downlink generation system includes a downlink command manager. The downlink command manager may determine a downlink command, or a sequence of several downlink commands, for the downhole tool to implement.

In some embodiments, the downlink command manager may access a target state for the downhole tool. As described herein, the target state may indicate, based on a set of tool commands, an operation mode for the downhole tool to implement, as well as operation parameters and associate operation parameters values to implement for the operation mode for a given section or transition of the trajectory.

Based on the target state, the downlink command manager may select, from a set of candidate downlink commands, a downlink command sequence of one or several downlink commands. For example, the candidate downlink commands may include some or all of the downlink commands indicated in the downlink definitions of the downhole tool configuration. The downlink command manager may select the downlink command sequence for the downhole tool to implement in order to execute the tool command and/or achieve the target state. For example, the downlink command sequence may be a set of one or more downlink commands that result in (or approximate as described herein) a target operation mode and/or target operation parameters of the target state.

In some embodiments, the downlink command sequence may include an operation mode downlink command, or a downlink command for instructing the downhole tool to implement a specific operation mode. For example, based on the tool command, the downlink command manager may determine a target operation mode for the downhole tool to implement. The downlink command manager may compare the target operation mode to a current operation mode of a current state of the downhole tool and, based on the current operation mode being a different operation mode than the target operation mode, the downlink command manager may determine an operation mode downlink command to include in the downlink command sequence for the downhole tool to implement the target operation mode. As an illustrative example, the downlink command manager may identify that a current operation mode for the current state of the downhole tool is an operation mode of "AC" and may additionally identify that in order to achieve a target state of an upcoming transition of the trajectory, the tool command indicates a target operation mode of "Build and Turn." Accordingly, the downlink command manager may select, from the candidate downlink commands, an operation mode downlink command to include in the downlink command sequence for changing the operation mode to "Build and Turn." In some embodiments, the downlink command manager determines that the target operation mode and the current operation mode are the same, and accordingly determines that an operation mode downlink command does not need to be incorporated into the downlink command sequence. In this way, the downlink command sequence may facilitate implementing a target operation mode of the target state.

In some embodiments, the downlink command sequence includes one, or multiple, operation parameter downlink commands. The operation parameters downlink commands may be downlink commands associated with implementing specific operation parameters, at associated operation parameter values, for a given operation mode. For example, based on the tool command, the downlink command manager may determine one or more target operation parameter values for target operation parameters for the downhole tool to implement. The downlink command manager may compare the target operation parameter values for the target operation parameters to current operation parameter values of current operation parameters. Based on one or more of the current operation parameters and current operation parameter values being different than the associated target operation parameters and target operation parameter values, the downlink command manager may determine one or more operation parameter downlink commands for the downhole tool to include in the downlink command sequence for the downhole tool to implement the target operation parameter at the target operation parameter values. For example, the downlink command manager may identify that the current operation parameters for the current state of the downhole tool are a toolface angle of 53° and a steering ratio of 75%. The downlink command may additionally identify that in order to achieve a target state for an upcoming transition of the trajectory, the tool command indicates target operation parameters of a toolface angle of 74° and a steering ratio of 75%. Accordingly, the downlink command manager may select, from the candidate downlink commands, one or more operation parameter downlink commands for including in the downlink command sequence for changing the toolface angle from 53° to 74° and maintaining the steering ratio at 75%. In this way, the downlink command sequence may facilitate implementing target operation parameters of the target state.

In some embodiments, the operation mode downlink command may be a first downlink command in the downlink command sequence. For example, as described herein, each operation mode may have a specific set of operation parameters for implementing in connection with that operation mode, and the operation mode downlink command may be a first downlink command in the downlink command sequence in order to establish or implement the operation mode, for example, prior to implementing the specific operation parameters of the operation mode.

As mentioned above, the downhole tool may be configured to operate based on a limited number of downlink commands and/or downlinks. This may be due to the fact that communication with the downhole tool is achieved by sending signals encoded into surface parameters supplied to the downhole tool such as a flowrate or pressure of drilling fluid, or a rotational speed (RPM) of the drill string. Thus, in some embodiments, communication with the downhole tool, which may be located miles below the surface of the wellbore may be difficult, slow, rudimentary, and cumbersome. Accordingly, the number of available downlinks (and associated downlink commands) for communicating with the downhole tool may be limited. For instance, the downhole tool may be configured to communicate via 64 downlink IDs (e.g., for each operation mode) and associated downlink commands.

In some embodiments, the tool command of the drill plan may indicate for the downhole tool to implement one or more operation parameters with operation parameter values that may not be possible to substantially achieve given the limited set of available downlink commands. To elaborate, in some cases a tool command of the drill plan may indicate certain operation parameter values for achieving one or more sections of the trajectory, but it may not be possible to communicate the exact operation parameter values to the downhole tool with the limited downlink commands for which the downhole tool is configured. As an illustrative example, a tool command may indicate to achieve a portion of the trajectory by implementing a tool face angle of 68°, but the downlink definitions may only include downlink commands for implementing a toolface angle of 45°, 54°, 72°, 90°, etc. (e.g., values that are not substantially) 68°. Additionally, the downlink definitions may include downlink commands for implementing changes to the toolface angle of +12°, −12°, +20°,−20°, etc., such that, even so, a combination of downlink commands may not be able to achieve a toolface angle of substantially 68°.

In some embodiments, the downlink command manager may generate the operation parameter downlink commands by selecting one downlink command, or a combination of several, ordered downlink commands, of the candidate downlink commands for approximating the target operation parameter value of a given target operation parameter. For example, for a tool command that indicates a target operation parameter of a toolface angle of 130°, the downlink command manager may select a downlink command for setting the toolface angle to 135°. In another example, the downlink command manager may select a sequence of downlink commands including a downlink command for setting the toolface angle to 144° followed by a downlink command for decreasing the toolface angle by 12°, resulting in a toolface angle of 132°.

In some embodiments, the downlink command manager may select one downlink command, or a combination of downlink commands, that result in a closest value to the target operation parameter value. In some embodiments, the downlink command manager may prioritize implementing fewer operation parameter downlink commands. For example, a combination of larger downlink commands may arrive closer to a given operation parameter value than a combination of fewer (e.g., or a single) downlink commands, and the downlink command manager may implement the smaller combination of downlink commands in order to minimize the amount of downlinks to send to the downhole tool. In some embodiments, the downlink command manager may implement a less accurate but smaller combination of operation parameter downlink commands (e.g., a single downlink command) in this way based on the resulting operation parameter value being within a threshold of the target operation parameter value. In this way, the downlink command manager may determine one or more operation parameters downlink commands to include in the downlink command sequence for approximating a target operation parameter of the tool command.

In some embodiments, the tool command may indicate for the downhole tool to implement two or more operation parameters with associated operation parameter values that cannot be substantially achieved given the limited set of downlink commands. In such cases, the downlink command manager may implement various techniques for determine one or more operation parameter downlink commands for approximating each of the two or more operation parameter values.

As an example, the downlink command manager may determine (e.g., from the downhole tool configuration, user input, etc.) an operation parameter that is most important, and may prioritize approximating the associated operation parameter value more closely than for other, less important operation parameters. In another example, the downlink command manager may select the set of one or more operation parameter downlink commands that results in the closest approximations for all of the operation parameter values. For instance, the downlink command manager may implement an optimization or minimization function such as linear, polynomial, or complex regression functions for determining a best-fit set of downlink commands.

In some embodiments, the downlink command manager may select the operation parameters downlink command(s) based on representing the two or more operation parameters in an n-dimensional space. For example, each of the target operation parameters of the tool command may define a dimension in the n-dimensional space, and the downlink command manager may represent each of the candidate downlink commands, and each possible combination of the candidate downlink commands that are associated with those specific target operation parameters in the n-dimensional space. Thus, each possible combination of resulting operation parameter values for the combination of operation parameters may be represented in the n-dimensional space. Given a tool command that indicates to implement a target combination of operation parameter values that is not substantially expressed by one of the possible combinations of resulting operation parameters values in the n-dimensional space, the downlink command manager may determine which of all the possible operation parameter value combinations is closest to the target combination. For example, the downlink command manager may determine a minimum distance between the target operation parameter value combination and the possible combinations. The downlink command manager may implement any other suitable techniques for optimization, regression, minimization, etc. In this way, the downlink command manager may choose a set of operation parameter downlink commands that best approximates or represents target operation parameter values for a set of two or more target operation parameters.

In some embodiments, a relationship between two or more operation parameters that are to be implemented together may not be a linear relationship such that representing the relationship in a linear way and minimizing a (e.g., linear) distance to approximate the fit of each operation parameter may not be a suitable technique. For example, in some embodiments, one operation parameter may be more important or more highly weighted than another operation parameter. In another example, one operation parameter may influence another operation parameter, or in other words, one operation parameter (e.g., changing one operation parameter) may affect the way another operation parameter behaves or affects the downhole tool. In some embodiments, the downlink command manager may represent a set of two or more operation parameters in a non-linear way, such as with respect to a non-linear space or coordinate system.

In some embodiments, the downlink command manager represents a combination of two or more operation parameters that are to be implemented together by representing them in a complex number space. For example, the operation parameters of a toolface angle and a steering ratio may be implemented together, and the downlink command manager may represent the toolface angle as a first dimension and the steering ratio as a second dimension of the complex number space. The relationship between the toolface angle and the steering ratio may be complex and/or non-linear in that an angular change in the toolface angle may have a different effect on the steering tool at different steering ratios. For instance, the relationship between the variables and/or dimensions in the complex number space 500 may be described by the following relationship:

$$(TF,SR) \rightarrow SR \cdot e^{iTF}$$

for the dimensions of toolface angle (TF) and steering ratio (SR).

The downlink command manager may represent this complex relationship with a circular compass-style space, or any other form of coordinate system. The dimensions of the complex number space 500 may be any other dimensions or variable, and may be related based on any other relationship.

The downlink command manager may represent each possible combination of operation parameter values for the toolface angle and steering ratio (e.g., resulting from each possible downlink command or combination of downlink commands from the candidate downlink commands) in the complex number space as a plurality of candidate combinations of operation parameter values. Based on a given tool command, the downlink command manager may represent a target combination of target operation parameter values in the complex number space. The downlink command manager may select a final combination of operation parameter values to approximate the target combinations based on selecting a candidate combination that is closest to the target combination. For example, the downlink command manager may determine which candidate combination has a shortest polar or complex distance to the target combination. The downlink command manager may implement any other technique for optimizing or selecting a best-fit candidate combination. Based on the final combination, the downlink command manager may determine the downlink command, or sequence of downlink commands, which may be implemented in order to achieve the final combination.

In some embodiments, the downlink command manager may implement artificial intelligence (AI) for determining a downlink command sequence. For example, the downlink command manager may utilize an AI planning workflow for determining the downlink command sequence. To elaborate, the downlink command manager may be implemented in a planning domain description language (PDDL) that describes various aspects of the downhole system and/or the downhole tool, and defines the candidate downlink commands, as well as the current state and the target state of the downhole tool. An AI planning engine may find the optimal downlink command sequence from the candidate downlink commands in order to execute the tool command.

In some embodiments, the downlink command manager may implement a machine learning model for determining the downlink command sequence. For example, the downlink command manager may use one or more downlink generation machine learning models to generate a downlink command sequence. The downlink generation machine learning models may include different types of downlink generation neural networks, such as classification machine learning models with neural network architectures (e.g., Monte Carlo dropout prediction model, transformer-based models, large generative model-based segmentation neural networks, etc.).

For example, the downlink generation machine learning model may receive a current state and a target state of the downhole tool as inputs (e.g., input states), and may be trained to classify the target state based on the set of candidate downlink commands in order to generate a downlink command sequence that best represents or approximates the tool commands of the target state. To elaborate, the downlink generation machine learning model may be a convolutional neural network (CNN) that includes several neural network layers, such as lower neural network layers that form an encoder, and higher neural network layers that form a decoder. For example, the encoder may map or encode aspects of the target state and current state into feature vectors (i.e., latent object feature maps or latent object feature vectors) by processing each input state through various neural network layers (e.g., convolutional, ReLU, and/or pooling layers) to encode data, measurements, parameters, etc., related to the input states into feature vectors (e.g., a string of numbers in vector space representing the encoded image data). For instance, the encoder of the downlink generation machine learning model may process data associated with the target and input states to encode features corresponding to operation mode and operation parameters from the input states. The downlink generation machine learning model may incorporate other data, measurements, properties, etc., associated with the current and target states such as downhole or surface measurements, formation properties, trajectory measurements, or any other associated data in order to learn relationships between these data and a resulting downlink command sequence.

Additionally, in various implementations, the downlink generation machine learning model includes higher neural network layers that form a decoder, which may include fully connected layers and/or a classifier function (e.g., a SoftMax or a sigmoid function). In these implementations, the decoder processes the feature vectors to decode detected relationships in an encoded state vector and generates a downlink command sequence for approximating the target state. The downlink generation machine learning model may often be trained offline but may be trained on the fly.

In this way, the downlink command manager may implement a downlink generation machine learning model that may be trained to determine a downlink command sequence for approximating a tool command, including an operation mode downlink command and/or operation parameter downlink commands in order to achieve a target state for the downhole tool.

As mentioned above, the downlink generation system includes a downlink sequence manager. The downlink sequence manager may determine a sequence of one or more downlinks for communicating to the downhole tool.

The downlink sequence manager may receive a downlink command sequence of one or more downlink commands for instructing the downhole tool to implement a specific operation mode and/or operation parameters as described herein. Based on the downlink command sequence, the downlink sequence manager may determine a corresponding downlink sequence of one or more downlinks. For example, based on the specific downlink commands of the downlink command sequence, the downlink sequence manager may identify which downlink IDs (and an associated sequence or order for the downlink IDs) to communicate to the downhole tool in order to implement the associated downlink command sequence.

In some embodiments, the downlink sequence manager may identify associated bit patterns for the downlink sequence to communicate the downlink IDs to the downhole tool. For example, based on the downlink definitions, the downhole tool may identify and/or generate a bit pattern or a sequence of several bit patterns for communicating the associated downlink sequence (e.g., the downlink IDs) to the downhole tool.

In some embodiments, the downlink sequence manager may facilitate encoding the bit patterns into one or more surface parameters. For example, the downlink sequence manager may provide the downlink sequence to facilitate modulating one or more of a fluid flowrate, a standpipe pressure, or an RPM provided at the surface of the wellbore to the downhole tool. In this way, the downhole tool may receive the downlink sequence through the surface parameters and interpret the downlink sequence in order to implement the downlink commands of the downlink command sequence.

In some embodiments, the downlink generation system may generate a first downlink sequence associated with a first section of a wellbore trajectory. The first section may be a portion of the wellbore from about 9100 ft to about 9500 ft. A first tool command may indicate a target operation mode of "Build and Turn" with associated target operation parameters of a toolface angle of 169° to the right (e.g., 169° in a positive direction) and a steering ratio of 49% in order to achieve the first section of the trajectory. Accordingly, the downlink generation system may determine the first downlink sequence based on a sequence of downlink commands and associated downlink IDs for executing the first tool command. For example, the downlink generation system may determine that the operation mode of the downhole tool is already set to "Build and Turn" and may accordingly not include a downlink command in the downlink sequence for instructing the downhole tool to implement the "Build and Turn" mode. The first downlink sequence may indicate for the tool to set a toolface mode for the toolface to "gravity mode" based on a downlink ID of 2-27. Further the first downlink sequence indicates for the downhole tool to achieve the target operation parameters of the first tool command based on a sequence of downlink commands to set the toolface angle to 180° and the steering ratio to 50% (downlink ID 1-24) and then decrease the toolface angle by 12° (downlink ID 2-16) resulting in a toolface angle of 168°. In this way, the downlink generation system may generate the first downlink sequence which may approximate the first tool command.

The downlink generation system may generate a second downlink sequence associated with a second section of a wellbore trajectory. The second section may be a portion of the wellbore from about 9500 ft to about 10300 ft. A second tool command may indicate a target operation mode of "IH" with associated target operation parameters of a target inclination of +1° and an azimuthal steering ratio of 20% in order to achieve the second section of the trajectory. Accordingly, the downlink generation system may determine the second downlink sequence based on a sequence of downlink commands and associated downlink IDs for executing the second tool command. For example, the second downlink sequence indicates for the tool to set the operation mode to "IH" based on a downlink ID of 2-27. Further the first downlink sequence indicates for the downhole tool to achieve the target operation parameters of the second tool command based on a sequence of downlink commands to increase the target inclination by 1° (downlink ID 1-5) and then implement a 20% continuous right turn (downlink ID 1-29). In this way, the downlink generation system 120 may generate the second downlink sequence which may substantially execute the second downlink command.

The downlink generation system may generate a third downlink sequence associated with a third section of a wellbore trajectory. The third section may be a portion of the wellbore from about 10300 ft and beyond. A third tool command may indicate a target operation mode of "Build and Turn" with associated target operation parameters of a toolface angle of 66° to the left (e.g., 66° in the negative direction) and a steering ratio of 50% in order to achieve the third section of the trajectory. Accordingly, the downlink generation system may determine the third downlink sequence based on a sequence of downlink commands and associated downlink IDs for executing the third tool command. For example, the third downlink sequence indicates for the tool to set the operation mode to "Build and Turn" based on a downlink ID of 1-0. The third downlink sequence indicates for the tool to set a toolface mode for the toolface to "gravity mode" based on a downlink ID of 2-27. Further the third downlink sequence indicates for the downhole tool to achieve the target operation parameters of the third tool command based on a downlink command to set the toolface angle to 288° and the steering ratio to 50% (downlink ID 1-5) resulting in a toolface angle of 72° to the left. In this way, the downlink generation system may generate the third downlink sequence which may approximate the third downlink command.

In some embodiments, a method or a series of acts for implementing an operation of a downhole tool within a wellbore as described herein, according to at least one embodiment of the present disclosure. The acts can be performed as part of a method. Alternatively, a non-transitory computer-readable medium can include instructions that, when executed by one or more processors, cause a computing device to perform the acts described herein. In still further embodiments, a system can perform the acts described herein.

In some embodiments, the method includes an act of identifying a tool command for a downhole tool. More specifically, the act may include identifying a tool command for a downhole tool to change a current state of the downhole tool to a target state. For example, the current state of the downhole tool may include an operation mode of the downhole tool and a set of operation parameters with associated operation parameter values for the operation mode. In some embodiments, the downhole tool is a steering tool and the tool command indicates to change the current state based on changing one or more of a steering mode of the downhole tool or a set of steering parameters with associated steering parameter values for the steering mode. The tool command may indicate to change the current state based on changing one or more of the operation mode or the set of operation parameters. For example, the tool command may be associated with steering the steering tool in a non-vertical orientation.

In some embodiments, the method includes an act of determining a set of one or more downlink commands. More specifically, the act may include determining, from a set of candidate downlink commands, a set of one or more downlink commands associated with executing the tool command. In some embodiments, the target state cannot be achieved by any single candidate downlink command of the set of candidate downlink commands, and determining the set of one or more downlink commands includes determining a combination of two or more candidate downlink commands for executing the tool command. In some embodiments, the target state cannot be achieved by combinations of one or more candidate downlink commands of the set of candidate downlink commands, and the set of one or more downlink commands is determined based on being the closest among the combinations of one or more candidate downlink commands.

In some embodiments, the tool command indicates for the downhole tool to implement a target operation parameter with a target operation parameter value, and the set of one or more downlink commands includes a sequence of downlink commands that instructs the downhole tool to execute the tool command based on a first downlink command indicating for the downhole tool to implement the target operation parameter with a first operation parameter value, wherein the first operation parameter value is not the target operation parameter value a second downlink command indicating for the downhole tool to change the first operation parameter value by a second value to implement a final operation parameter value for the first operation parameter. In some embodiments, the final operation parameter value is the target operation parameter values. In some embodiments, the final operation parameter value is not the target operation parameter value, and the sequence of downlink commands is determined based on the final operation parameter value being closest to the target operation parameter value among operation parameter values from any combination of one or more candidate downlink commands of the set of candidate downlink commands.

In some embodiments, the current state of the downhole tool includes a first operation mode of the downhole tool and first operation parameters with associated first operation parameter values for the first operation mode, and the tool command indicates for the downhole tool to implement a second operation mode and second operation parameters with associated target operation parameter values for the second operation mode, and wherein the set of one or more downlink commands includes a sequence of downlinks including a first one or more downlinks indicating for the downhole tool to implement the second operation mode, and a second one or more downlinks indicating for the downhole tool to implement the second operation parameters with associated second operation parameter values. In some embodiments, the second operation parameter values are not the target operation parameter values, and the set of one or more downlink commands are determined based on the second operation parameter values being closest to the target operation parameter values among operation parameter values from any combination of one or more candidate downlink commands of the set of candidate downlink commands.

In some embodiments, the tool command indicates for the downhole tool to implement a target set of operation parameters including a first target operation parameter value for a first operation parameter and a second target operation parameter value for a second operation parameter, and wherein determining the set of one or more downlink commands includes representing the target set of operation parameters and a set of candidate downlink command combinations in a complex number space and selecting a downlink command combination from the set of candidate downlink command combinations based on a complex distance between the downlink command combination and the target set of operation parameters. In some embodiments, a behavior effect or behavior characteristic of the first operation parameters on the downhole tool is dependent on the second operation parameter. For example, the first operation parameter may be a toolface angle and the second operation parameter may be a steering ratio.

In some embodiments, the set of one or more downlink commands is determined by a downlink generation machine learning model trained to classify the tool command based on the set of candidate downlink commands, and the set of one or more downlink commands is selected based on having a highest probability of achieving the target state among all combinations of one or more candidate downlink commands of the set of candidate downlink commands.

In some embodiments, the method includes an act of generating a downlink sequence. More specifically, the act may include generating a downlink sequence of one or more downlinks for communicating the set of one or more downlink commands to the downhole tool.

In some embodiments, the method includes an act of providing the downlink sequence for transmitting to the downhole tool. For example, the downlink sequence may be transmitted to the downhole tool based on encoding the downlink sequence into one or more surface parameters provided to the downhole tool from the surface of the wellbore. In some embodiments, the downhole tool executes the set of one or more downlink commands to change the current state of the downhole tool.

In some embodiments, certain components may be included within a computer system. One or more computer systems may be used to implement the various devices, components, and systems described herein.

The computer system includes a processor. The processor may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor may be referred to as a central processing unit (CPU). Although just a single processor is described, in an alternative configuration, a combination of processors (e.g., an ARM and DSP) could be used.

The computer system also includes memory in electronic communication with the processor. The memory may include computer-readable storage media and can be any available media that can be accessed by a general purpose or special purpose computer system. Computer-readable media that store computer-executable instructions are non-transitory computer-readable media (device). Computer-readable media that carry computer-executable instructions are transmission media. Thus, by way of example and not limitations, embodiment of the present disclosure can comprise at least two distinctly different kinds of computer-readable media: non-transitory computer-readable media (devices) and transmission media.

Both non-transitory computer-readable media (devices) and transmission media may be used temporarily to store or carry software instructions in the form of computer readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which can be used to store program code in the form of computer-executable instructions or data structures and which can be accessed by a general purpose or special purpose computer, whether such program code is stored or in software, hardware, firmware, or combinations thereof.

Instructions and data may be stored in the memory. The instructions may be executable by the processor to implement some or all of the functionality disclosed herein. Executing the instructions may involve the use of the data that is stored in the memory. Any of the various examples of modules and components described herein may be implemented, partially or wholly, as instructions stored in memory and executed by the processor. Any of the various examples of data described herein may be among the data that is stored in memory and used during execution of the instructions by the processor.

A computer system may also include one or more communication interfaces for communicating with other electronic devices. The communication interface(s) may be based on wired communication technology, wireless communication technology, or both. Some examples of communication interfaces include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

The communication interfaces may connect the computer system to a network. A "network" or "communications network" may generally be defined as one or more data links that enable the transport of electronic data between computer systems and/or modules, engines, or other electronic devices, or combinations thereof. When information is transferred or provided over a communication network or another communications connection (either hardwired, wireless, or a combination of hardwired or wireless) to a computing device, the computing device properly views the connection as a transmission medium. Transmission media can include a communication network and/or data links, carrier waves, wireless signals, and the like, which can be used to carry desired program or template code means or instructions in the form of computer-executable instruction or data structures and which can be accessed by a general purpose or special purpose computer.

A computer system may also include one or more input devices and one or more output devices. Some examples of input devices include a keyboard, mouse, microphone, remote control device, button, joystick, trackball, touchpad, and lightpen. Some examples of output devices include a speaker and a printer. One specific type of output device that is typically included in a computer system is a display device. Display devices used with embodiments disclosed herein may utilize any suitable image projection technology, such as liquid crystal display (LCD), light-emitting diode (LED), gas plasma, electroluminescence, or the like. A display controller may also be provided, for converting data stored in the memory into one or more of text, graphics, or moving images (as appropriate) shown on the display device.

The various components of the computer system may be coupled together by one or more buses, which may include one or more of a power bus, a control signal bus, a status signal bus, a data bus, other similar components, or combinations thereof.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures can be transferred automatically or manually from transmission media to non-transitory computer-readable storage media (or vice versa). For example, computer executable instructions or data structures received over a network or data link can be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media can be included in computer system components that also (or even primarily) utilize transmission media.

The following description from ¶¶ [0183]-[0202] includes various embodiments that, where feasible, may be combined in any permutation. For example, the embodiment of ¶ [0183] may be combined with any or all embodiments of the following paragraphs. Embodiments that describe acts of a method may be combined with embodiments that describe, for example, systems and/or devices. Any permutation of the following paragraphs is considered to be hereby disclosed for the purposes of providing "unambiguously derivable support" for any claim amendment based on the following paragraphs. Furthermore, the following paragraphs provide support such that any combination of the following paragraphs would not create an "intermediate generalization."

In some embodiments, a method of implementing an operation of a downhole tool within a wellbore includes identifying a tool command for a downhole tool to change a current state of the downhole tool to a target state. The method further includes determining, from a set of candidate downlink commands, a set of one or more downlink commands associated with executing the tool command. The method further includes generating a downlink sequence of one or more downlinks for communicating the set of one or more downlink commands to the downhole tool. The method further includes providing the downlink sequence for transmitting to the downhole tool.

In some embodiments, the current state of the downhole tool includes an operation mode of the downhole tool and a set of operation parameters with associated operation parameter values for the operation mode.

In some embodiments, the tool command indicates to change the current state based on changing one or more of the operation mode or the set of operation parameters.

In some embodiments, the downhole tool is a steering tool and the tool command indicates to change the current state based on changing one or more of a steering mode of the downhole tool or a set of steering parameters with associated steering parameter values for the steering mode.

In some embodiments, the tool command is associated with steering the steering tool in a non-vertical orientation.

In some embodiments, the target state cannot be achieved by any single candidate downlink command of the set of candidate downlink commands, and determining the set of one or more downlink commands includes determining a combination of two or more candidate downlink commands for executing the tool command.

In some embodiments, the target state cannot be achieved by combinations of one or more candidate downlink commands of the set of candidate downlink commands, and the set of one or more downlink commands is determined based on being the closest among the combinations of one or more candidate downlink commands.

In some embodiments, the tool command indicates for the downhole tool to implement a target operation parameter with a target operation parameter value, and the set of one or more downlink commands includes a sequence of downlink commands that instructs the downhole tool to execute the tool command based on a first downlink command indicating for the downhole tool to implement the target operation parameter with a first operation parameter value, wherein the first operation parameter value is not the target operation parameter value, and a second downlink command indicating for the downhole tool to change the first operation parameter value by a second value to implement a final operation parameter value for the target operation parameter.

In some embodiments, the final operation parameter value is the target operation parameter value.

In some embodiments, the final operation parameter value is not the target operation parameter value, and the sequence of downlink commands is determined based on the final operation parameter value being closest to the target operation parameter value among operation parameter values from any combination of one or more candidate downlink commands of the set of candidate downlink commands.

In some embodiments, the current state of the downhole tool includes a first operation mode of the downhole tool and first operation parameters with associated first operation parameter values for the first operation mode, and the tool command indicates for the downhole tool to implement a second operation mode and second operation parameters with associated target operation parameter values for the second operation mode, and the set of one or more downlink commands includes a sequence of downlinks including a first one or more downlinks indicating for the downhole tool to implement the second operation mode, and a second one or more downlinks indicating for the downhole tool to implement the second operation parameters with associated second operation parameter values.

In some embodiments, the second operation parameter values are not the target operation parameter values, and the set of one or more downlink commands are determined based on the second operation parameter values being closest to the target operation parameter values among operation parameter values from any combination of one or more candidate downlink commands of the set of candidate downlink commands.

In some embodiments, the method includes transmitting the downlink sequence to the downhole tool based on encoding the downlink sequence into one or more surface parameters provided to the downhole tool from the surface of the wellbore.

In some embodiments, the method includes executing, with the downhole tool, the set of one or more downlink commands to change the current state of the downhole tool.

In some embodiments, the tool command indicates for the downhole tool to implement a target set of operation parameters including a first target operation parameter value for a first operation parameter and a second target operation parameter value for a second operation parameter, and determining the set of one or more downlink commands includes representing the target set of operation parameters and a set of candidate downlink command combinations in a complex number space, and selecting a downlink command combination from the set of candidate downlink command combinations based on a complex distance between the downlink command combination and the target set of operation parameters.

In some embodiments, a behavior effect of the first operation parameter on the downhole tool is dependent on the second operation parameter.

In some embodiments, the first target operation parameter is a toolface angle and the second operation parameter is a steering ratio.

In some embodiments, the set of one or more downlink commands is determined by a downlink generation machine learning model trained to classify the tool command based on the set of candidate downlink commands, and the set of one or more downlink commands is selected based on having a highest probability of achieving the target state among all combinations of one or more candidate downlink commands of the set of candidate downlink commands.

In some embodiments, a system includes at least one processor, memory in electronic communication with the at least one processor, and instructions stored in the memory, the instructions being executable by the at least one processor to identify a tool command for a downhole tool to change a current state of the downhole tool to a target state. In some embodiments, the instructions are executable by the processor to determine, from a set of candidate downlink commands, a set of one or more downlink commands associated with executing the tool command. In some embodiments, the instructions are executable by the processor to generate a downlink sequence of one or more downlinks for communicating the set of one or more downlink commands to the downhole tool. In some embodiments, the instructions are executable by the processor to provide the downlink sequence for transmitting to the downhole tool.

In some embodiments, a computer-readable storage medium includes instruction that, when executed by at least one processor, cause the processor to identify a tool command for a downhole tool to change a current state of the downhole tool to a target state. In some embodiments, the instructions cause the processor to determine, from a set of candidate downlink commands, a set of one or more downlink commands associated with executing the tool command. In some embodiments, the instructions cause the processor to generate a downlink sequence of one or more downlinks for communicating the set of one or more downlink commands to the downhole tool. In some embodiments, the instructions cause the processor to provide the downlink sequence for transmitting to the downhole tool.

The embodiments of the downlink generation system have been primarily described with reference to wellbore drilling operations; the downlink generation system described herein may be used in applications other than the drilling of a wellbore. In other embodiments, the downlink generation system according to the present disclosure may be used outside a wellbore or other downhole environment used for the exploration or production of natural resources. For instance, the downlink generation system of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method of implementing an operation of a downhole tool within a wellbore, comprising:

identifying a tool command for the downhole tool to change a current state of the downhole tool to a target state;

determining, from a set of candidate downlink commands, a set of one or more downlink commands associated with executing the tool command, wherein determining the set of one or more downlink commands includes identifying the set of one or more downlink commands that is closest to the tool command in an n-dimensional space;

generating a downlink sequence of one or more downlinks for communicating the set of one or more downlink commands associated with executing the tool command to the downhole tool; and providing the downlink sequence for transmitting to the downhole tool.

2. The method of claim 1, wherein the current state of the downhole tool includes an operation mode of the downhole tool and a set of operation parameters with associated operation parameter values for the operation mode.

3. The method of claim 2, wherein the tool command indicates to change the current state based on changing one or more of the operation mode or the set of operation parameters.

4. The method of claim 1, wherein the downhole tool is a steering tool and the tool command indicates to change the current state based on changing one or more of a steering mode of the downhole tool or a set of steering parameters with associated steering parameter values for the steering mode.

5. The method of claim 4, wherein the tool command is associated with steering the steering tool in a non-vertical orientation.

6. The method of claim 1, wherein the target state cannot be achieved by any single candidate downlink command of the set of candidate downlink commands, and determining the set of one or more downlink commands associated with executing the tool command includes determining a combination of two or more candidate downlink commands for executing the tool command.

7. The method of claim 1, wherein the target state cannot be achieved by combinations of one or more candidate downlink commands of the set of candidate downlink commands.

8. The method of claim 1, wherein the tool command indicates for the downhole tool to implement a target operation parameter with a target operation parameter value, and the set of one or more downlink commands associated with executing the tool command includes a sequence of downlink commands that instructs the downhole tool to execute the tool command based on:

a first downlink command indicating for the downhole tool to implement the target operation parameter with a first operation parameter value, wherein the first operation parameter value is not the target operation parameter value; and a second downlink command indicating for the downhole tool to change the first operation parameter value by a second value to implement a final operation parameter value for the target operation parameter.

9. The method of claim 8, wherein the final operation parameter value is the target operation parameter value.

10. The method of claim 8, wherein the final operation parameter value is not the target operation parameter value, and wherein the sequence of downlink commands is determined based on the final operation parameter value being closest to the target operation parameter value among operation parameter values from any combination of one or more candidate downlink commands of the set of candidate downlink commands.

11. The method of claim 1, wherein the current state of the downhole tool includes a first operation mode of the downhole tool and first operation parameters with associated first operation parameter values for the first operation mode, and the tool command indicates for the downhole tool to implement a second operation mode and second operation parameters with associated target operation parameter values for the second operation mode, and wherein the set of one or more downlink commands associated with executing the tool command includes a sequence of downlinks including:

a first one or more downlinks indicating for the downhole tool to implement the second operation mode; and a second one or more downlinks indicating for the downhole tool to implement the second operation parameters with associated second operation parameter values.

12. The method of claim 11, wherein the second operation parameter values are not the target operation parameter values, and the set of one or more downlink commands associated with executing the tool command is determined based on the second operation parameter values being closest to the target operation parameter values among operation parameter values from any combination of one or more candidate downlink commands of the set of candidate downlink commands.

13. The method of claim 12, further comprising executing, with the downhole tool, the set of one or more downlink commands associated with executing the tool command to change the current state of the downhole tool.

14. The method of claim 1, further comprising transmitting the downlink sequence to the downhole tool based on encoding the downlink sequence into one or more surface parameters provided to the downhole tool from a surface of the wellbore.

15. The method of claim 1 wherein the tool command indicates for the downhole tool to implement a target set of operation parameters including a first target operation parameter value for a first operation parameter and a second target operation parameter value for a second operation parameter, and wherein determining the set of one or more downlink commands associated with executing the tool command includes:

representing the target set of operation parameters and a set of candidate downlink command combinations in the n-dimensional space, wherein the n-dimensional space includes a complex number space; and selecting a downlink command combination from the set of candidate downlink command combinations based on a complex distance between the selected downlink command combination and the target set of operation parameters.

16. The method of claim 15, wherein a behavior effect of the first operation parameter on the downhole tool is dependent on the second operation parameter.

17. The method of claim 15, wherein the first target operation parameter is a toolface angle and the second operation parameter is a steering ratio.

18. The method of claim 1, wherein:

the set of one or more downlink commands associated with executing the tool command is determined by a downlink generation machine learning model trained to classify the tool command based on a set of candidate downlink commands in the n-dimensional space; and the set of one or more downlink commands that is closest to the tool command in the n-dimensional space has a highest probability of achieving the target state among all combinations of one or more candidate downlink commands of the set of candidate downlink commands in the n-dimensional space.

19. A system, comprising:

at least one processor;

memory in electronic communication with the at least one processor; and instructions stored in the memory, the instructions being executable by the at least one processor to:

identify a tool command for a downhole tool to change a current state of the downhole tool to a target state;

determine, from a set of candidate downlink commands, a set of one or more downlink commands associated with executing the tool command, wherein the set of one or more downlink commands is determined by identifying the set of one or more downlink commands that is closest to the tool command in an n-dimensional space;

generate a downlink sequence of one or more downlinks for communicating the set of one or more downlink commands associated with executing the tool command to the downhole tool; and provide the downlink sequence for transmitting to the downhole tool.

20. A non-transitory computer-readable storage medium including instruction that, when executed by at least one processor, cause the processor to:

identify a tool command for a downhole tool to change a current state of the downhole tool to a target state;

determine, from a set of candidate downlink commands, a set of one or more downlink commands associated with executing the tool command, wherein the set of one or more downlink commands is determined by identifying the set of one or more downlink commands that is closest to the tool command in an n-dimensional space;

generate a downlink sequence of one or more downlinks for communicating the set of one or more downlink commands associated with executing the tool command to the downhole tool; and provide the downlink sequence for transmitting to the downhole tool.

* * * * *